US009980580B2

(12) United States Patent
O'Donnell

(10) Patent No.: US 9,980,580 B2
(45) **Date of Patent: *May 29, 2018**

(54) BABY HANDLING DEVICE

(71) Applicant: Laura Marie O'Donnell, Hermosa Beach, CA (US)

(72) Inventor: Laura Marie O'Donnell, Hermosa Beach, CA (US)

( * ) Notice: Subject to any disclaimer, the term of this patent is extended or adjusted under 35 U.S.C. 154(b) by 504 days.

This patent is subject to a terminal disclaimer.

(21) Appl. No.: 14/805,987

(22) Filed: Jul. 22, 2015

(65) Prior Publication Data

US 2015/0342264 A1 Dec. 3, 2015

Related U.S. Application Data

(63) Continuation of application No. PCT/US2013/068703, filed on Nov. 6, 2013, and a continuation-in-part of application No. 14/570,193, filed on Dec. 15, 2014, now abandoned.

(51) Int. Cl.

| | |
|---|---|
| ***A47D 13/08*** | (2006.01) |
| ***A47G 9/02*** | (2006.01) |
| ***A47G 9/10*** | (2006.01) |
| ***A47G 9/08*** | (2006.01) |
| *A41B 13/06* | (2006.01) |

(52) U.S. Cl.

CPC ..... *A47D 13/083* (2013.01); *A47G 9/0253* (2013.01); *A47G 9/083* (2013.01); *A47G 9/10* (2013.01); *A41B 13/06* (2013.01)

(58) Field of Classification Search

CPC ..... A47D 13/083; A47D 13/08; A47D 5/00; A47D 15/00; A47D 15/001; A47D 15/003; A47G 9/0253; A47G 9/0238; A47G 9/10

USPC ... 5/655, 657, 652, 632, 630, 494, 490, 485, 5/482

See application file for complete search history.

(56) References Cited

U.S. PATENT DOCUMENTS

| | | | |
|---|---|---|---|
| 3,269,621 | A | 8/1966 | Dishart |
| 3,667,074 | A | 6/1972 | Emery |
| 4,173,048 | A | 11/1979 | Varaney |
| 4,434,513 | A | 3/1984 | Welch |
| 4,792,024 | A | 12/1988 | Morton |
| 4,862,535 | A | 9/1989 | Roberts |
| 5,014,376 | A | 5/1991 | Doran |
| D328,683 | S | 8/1992 | Kalozdi |

(Continued)

*Primary Examiner* — Robert G Santos

(74) *Attorney, Agent, or Firm* — David A. Belasco; Belasco Jacobs & Townsley, LLP

(57) ABSTRACT

A baby handling device includes a removable, washable pillow cover sized and shaped to fit over and extend from an irregular star-shaped pillow and provides at least two elongated star-point shaped extensions formed of flexible material and adapted to fold over and enclose at least a portion of a baby positioned on the cover. The cover has a closeable opening sized and shaped to permit insertion and removal of the pillow which is formed of resilient material and includes a broad center section with a central depression to receive a baby's head. A central point-shaped portion of the pillow extends upwardly from the depression and is adapted to lodge under an arm of a breast feeding mother. The pillow includes first and second side portions that surround a cavity that is sized and shaped to receive the shoulders and torso of the baby. The side portions support a baby's arms.

38 Claims, 32 Drawing Sheets

(56) References Cited

U.S. PATENT DOCUMENTS 5,439,008 A 8/1995 Bowman
5,546,620 A 8/1996 Matthews
5,551,109 A * 9/1996 Tingley ..... A47D 13/02 128/870
6,038,720 A 3/2000 Matthews
6,189,169 B1 2/2001 Marcotte
6,354,665 B1 3/2002 Ross
6,499,165 B1 12/2002 Morgillo
6,553,590 B1 * 4/2003 Leach ..... A47D 13/08 5/655
6,658,681 B2 12/2003 Britto
6,763,539 B1 7/2004 Bartley
7,010,821 B1 * 3/2006 Leach ..... A47D 13/083 5/636
7,127,760 B2 10/2006 Bartley
7,451,508 B2 11/2008 Matthews Brown
7,513,001 B1 * 4/2009 Leach ..... A47C 27/086 5/632
7,562,406 B1 * 7/2009 Leach ..... A47C 16/00 5/632
7,581,268 B2 9/2009 Bell
7,657,955 B1 2/2010 Alvistur
7,673,354 B2 3/2010 Fader
7,676,871 B1 * 3/2010 Leach ..... A47D 13/08 5/653
8,191,188 B2 6/2012 Kaplan
8,365,329 B1 * 2/2013 Barsosky ..... A47D 13/083 5/632
8,393,025 B2 3/2013 Crispino
8,418,295 B2 * 4/2013 Clark ..... A47D 13/083 5/632
8,495,775 B2 7/2013 Fair
8,516,638 B2 8/2013 Kummerfeld
8,555,429 B2 * 10/2013 Leach ..... A47K 3/127 4/572.1
8,671,485 B2 * 3/2014 Smallman ..... A47D 15/008 5/413 AM
9,693,638 B1 * 7/2017 Leach ..... A47D 13/08
2004/0200004 A1 10/2004 Matthews Brown
2006/0010600 A1 1/2006 Kendy
2006/0101579 A1 * 5/2006 Albers ..... A47D 13/083 5/655
2007/0022526 A1 * 2/2007 Leach ..... A01K 1/0353 4/572.1
2007/0271703 A1 11/2007 Matthews Brown
2008/0313812 A1 12/2008 Reeves
2009/0249526 A1 10/2009 Carangelo
2011/0119833 A1 * 5/2011 Clark ..... A47D 13/083 5/655
2012/0278994 A1 11/2012 Bonzer et al.
2013/0047343 A1 * 2/2013 Barsosky ..... A47D 13/083 5/655
2013/0174316 A1 7/2013 Smallman
2015/0121627 A1 * 5/2015 O'Donnell ..... A41D 1/205 5/639
2015/0342264 A1 * 12/2015 O'Donnell ..... A47D 13/083 5/655
2017/0181478 A1 * 6/2017 O'Donnell ..... A41B 13/065

* cited by examiner

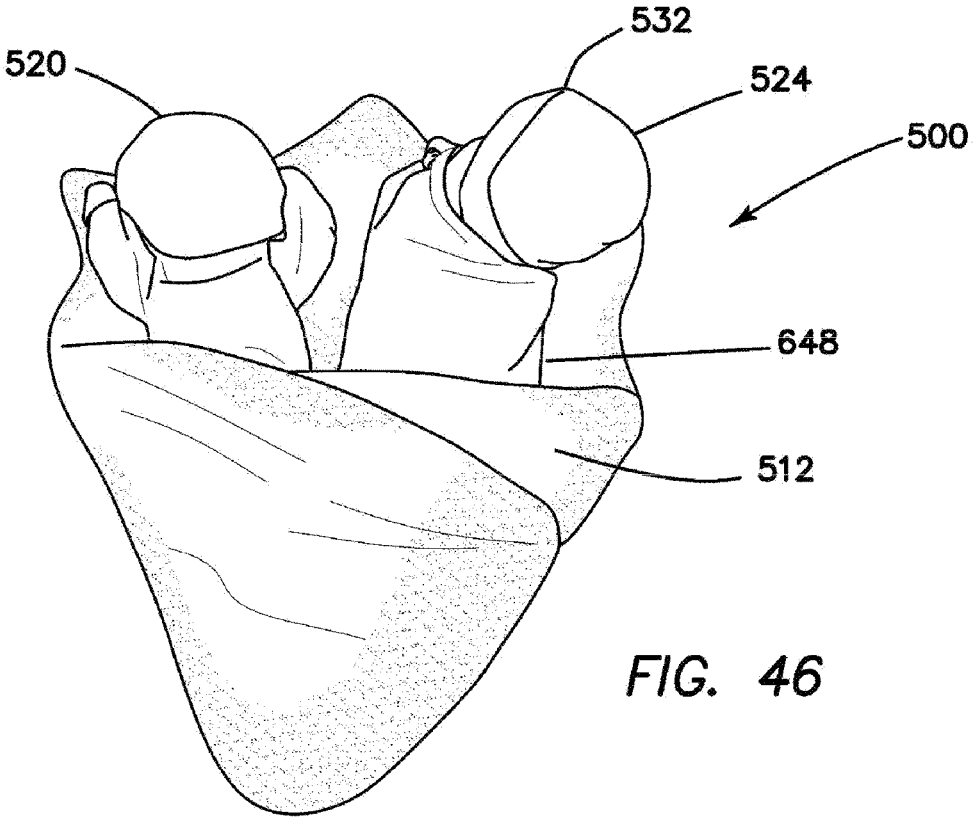
FIG. 46
FIG. 47
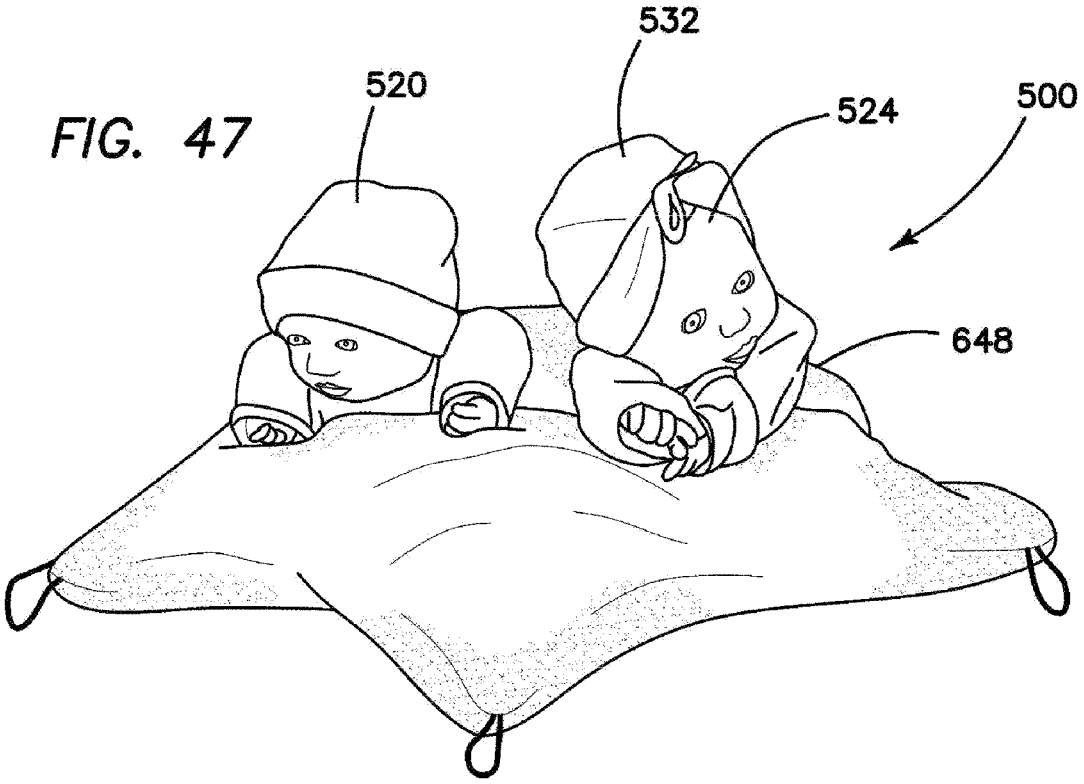

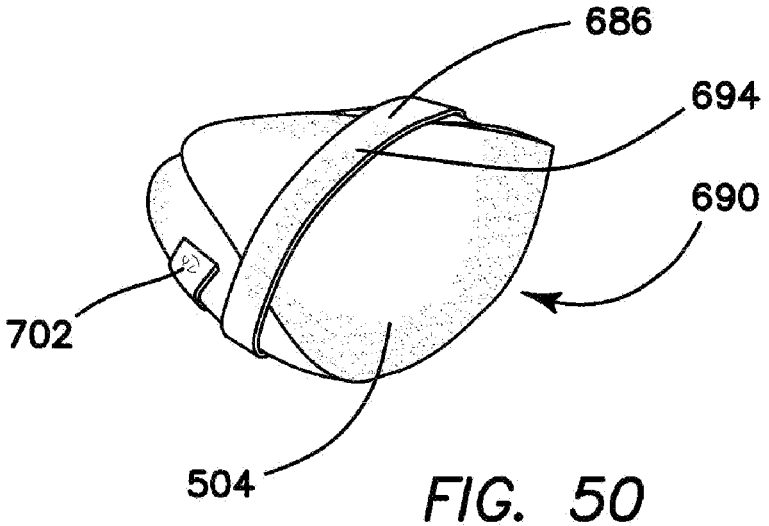
FIG. 50
FIG. 51
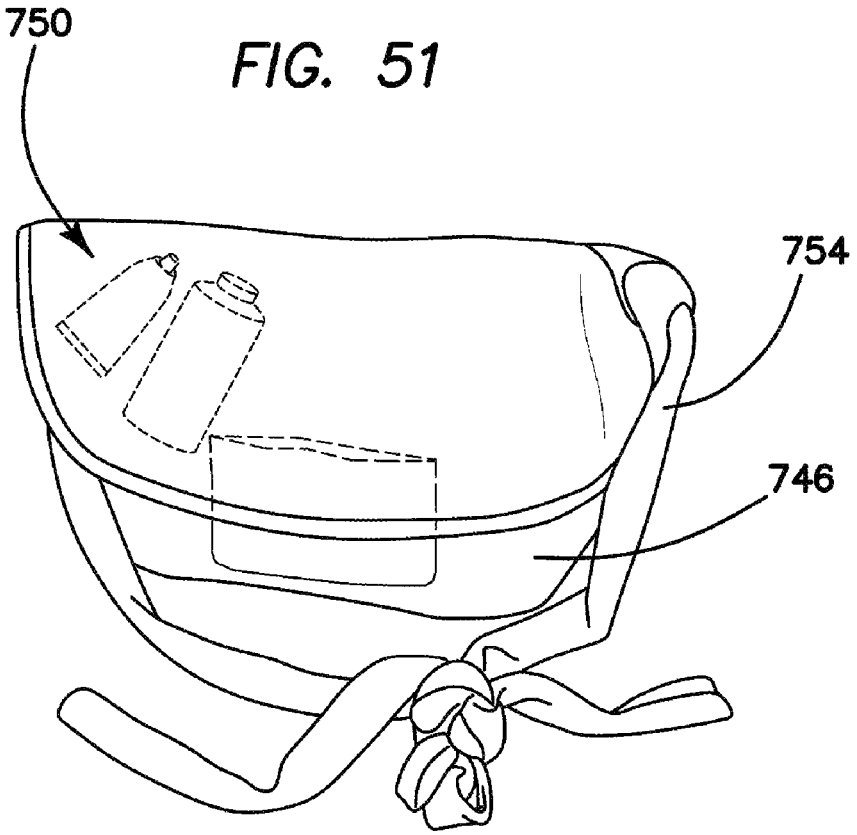

BABY HANDLING DEVICE

RELATED APPLICATION

The instant application is a continuation-in-part of U.S. application Ser. No. 14/570,193, filed Dec. 15, 2014 and currently abandoned, which is a continuation of PCT/US2013/068703, filed Nov. 6, 2013 and currently expired. The disclosure of these applications is hereby incorporated by reference in their entirety.

FIELD OF INVENTION

This invention relates to the field of infant care items and more specifically to a combination device for baby swaddling, support during breast feeding and other baby handling functions and use as an infant sleeping bag.

BACKGROUND OF THE INVENTION

Newborn children and infants require special and specific care to avoid injury when handled for feeding or even when left to rest. As infant neck muscles are just developing, it is critical that the baby's head be supported when the baby is leaned backward as it might be for feeding. When infants are placed in cribs to sleep, it is important that they are prevented from turning themselves face down where they could smother against the surface of the crib. For this reason, a means to prevent the infant from using his or her arms while sleeping is necessary. To address this problem, various techniques and devices have been developed to swaddle the infant and cause it to sleep safely on his or her back. As the baby grows, it is often desirable to have a portable, ready-made bed or sleeping bag for the baby to use when away from home. Various solutions to these problems have been proposed.

U.S. Pat. No. 7,127,760, issued to Bartley et al. is directed to a nursing pillow and methods. This device, a support pillow, includes a horseshoe shaped pillow body disposed around a well region. A support member is fixed in a portion of the well and is provided to support some or all of an object resting on the pillow. Construction of the pillow can vary with the top and bottom pieces being cut into U-shaped pieces and sewn together or two continuous pieces and sewn together with a seam forming the interior section of the U-shape providing structure for a continuous transition from the pillow sections to the support member. Pockets may be included on the outer periphery of the pillow.

U.S. Pat. No. 7,673,354, issued to Fader is directed to a baby sleeping pouch method and apparatus. This device is a pouch. A baby may be placed on a wedge pillow and positioned with in the pouch. Additionally, it is suggested that the baby may be swaddled in a blanket prior to insertion into the pouch.

U.S. Pat. No. 8,393,025, issued to Crispino et al. illustrates a bed covering system. This system includes a lower sheet and an upper sheet. At least one expandable flap joins the edges of the lower and upper sheets. A pocket may be supplied on the lower sheet near the pillow or pillow encasement.

U.S. Pat. No. 6,499,165, issued to Morgillo discloses an infant safety device. This safety device includes a U-shaped pillow support portion and a harness portion. A pillow case may be provided to cover the U-shaped pillow. In this embodiment, the harness portion is fixed to the pillow case.

U.S. Pat. No. 8,516,638, issued to Kummerfeld et al. is directed to a feeding pillow with a removable surface. The feeding pillow is generally U-Shaped or C-Shaped. The pillow has a pocket. A support member is positioned in the pocket and may be removed through an opening.

It is an objective of the present invention to provide a convenient baby support for breast feeding and other purposes in which the baby's head must be supported. It is a further objective to provide a device for constraining a baby's arms while resting or sleeping. It is a still further objective of the invention to provide a compact infant sleeping bag for use when traveling. It is yet a further objective to provide a baby handling device that can be easily maintained in a sanitary condition. Finally, it is an objective of the present invention to provide a baby handling device that is inexpensive, attractive, light weight and easily manufactured.

While some of the objectives of the present invention are disclosed in the prior art, none of the inventions found include all of the requirements identified.

SUMMARY OF THE INVENTION

The present invention addresses all of the deficiencies of prior art baby handling device inventions and satisfies all of the objectives described above.

(1) A baby handling device may be constructed from the following components. A horseshoe-shaped pillow is provided. The pillow is formed of resilient material, has a center section of a first height and adjacent first and second side sections that taper to opposite first and second ends of a second, lower height. A removable, washable cover is provided. The cover is sized and shaped to fit over the horseshoe-shaped pillow and provides a support platform. The platform is formed of flexible material and extends between an upper surface of the center section and at least a portion of upper surfaces of the side sections, said support platform becoming concave when supporting a baby. A restraining blanket is provided. The blanket is formed of flexible material and is removably and adjustably attached to at least an underside and a top surface of the cover of the horseshoe-shaped pillow. The horseshoe-shaped pillow provides support for a baby's head and neck. The support platform provides a determined position for the baby's body and the restraining blanket constrains movement of the baby's arms.

(2) In a variant of the invention, the horseshoe-shaped pillow is formed of impermeable material.

(3) In another variant, the removable cover further includes a storage pocket.

(4) In still another variant, the restraining blanket is attached to the removable cover with a plurality of fastening devices selected from the group that includes snaps, hook and eye combinations, buttons, looping and hooking fasteners and zippers.

(5) In yet another variant, the fastening devices provide attachment for the restraining blanket at a first position. The first position attaches the blanket at approximately shoulder height for a baby on at least the underside of the removable cover. The first position constrains the arms of the baby.

(6) In a further variant, the fastening devices provide attachment for the restraining blanket at a second position. The second position attaches the blanket at approximately abdomen height for a baby on at least the underside of the removable cover. The second position permits movement of arms of the baby.

(7) In still a further variant, the fastening devices provide attachment for the restraining blanket at a series of points on the underside of the removable cover, permitting use of the device as a sleeping bag for a baby of increasing height.

(8) In yet a further variant, the horseshoe-shaped pillow further includes an electrically operated vibrating element. The vibrating element causes the device to provide a soothing vibration to induce sleep in a baby.

(9) In another variant of the invention, the horseshoe-shaped pillow further includes at least one loudspeaker and electrically operated music source. The music source provides music to provide a calming environment for a baby.

(10) In still another variant, a combination fastening and carrying strap is provided. The strap serves to hold the device in a compact bundle and to provide a carrying handle. The strap is attached to either the removable cover or the restraining blanket with any of stitching, snaps, hook and eye combinations, buttons, looping and hooking fasteners and zippers.

(11) In yet another variant, the restraining blanket includes a plurality of fasteners. The fasteners secure the blanket about the horseshoe-shaped pillow in a compact bundle. The combination fastening and carrying strap provides a carrying handle for the bundle.

(12) In another variant of the invention, the adjustable combination fastening and carrying strap provides a mounting for baby toys and accessories and secures the baby to the horseshoe-shaped pillow.

(13) In still another variant, the removable cover for the horseshoe-shaped pillow further includes a closable opening. The opening provides for removal of the horseshoe-shaped pillow from the cover.

(14) In a final variant of the invention, the blanket is removed from the cover and provides a privacy shield during nursing.

(1) A baby handling device may be constructed from the following components. A removable, washable pillow cover is provided. The cover is sized and shaped to fit over and extend from an irregular star-shaped pillow and provides at least two elongated star-point shaped extensions. The extensions are formed of flexible material and adapted to fold over and enclose at least a portion of a baby positioned on the cover. An upper portion of the cover is adapted to support and control movement of a baby's head when the elongated star-point shaped extensions are wrapped around the baby and fastened to an outer surface of the cover. The cover has a closeable opening sized and shaped to permit insertion and removal of the pillow.

(2) In a variant of the invention, an irregular star-shaped pillow is provided. The pillow is formed of resilient material and includes a broad center section with a central depression sized and shaped to receive a baby's head. A central point-shaped portion of the pillow extends upwardly from the depression. The star-shaped portion is adapted to lodge under an arm of a breast feeding mother. The pillow includes first and second side portions. The side portions surround a cavity. The cavity is sized and shaped to receive the shoulders and torso of the baby. The side portions are sized and shaped to support a baby's arms.

(3) In another variant, the irregular star-shaped pillow further includes at least one fastening device and the cover includes at least one mating fastening device for securing the pillow within the cover.

(4) In still another variant, the fastening device is selected from the group includes tie strings, hook and eye combinations, hooking and looping devices, buttons, snaps and zippers.

(5) In yet another variant, the irregular star-shaped pillow is formed of impermeable material.

(6) In a further variant, the removable cover further includes a storage pocket.

(7) In still a further variant, at least one attachment device is provided. The attachment device provides attachment for a distal end of the elongated star-point shaped extension to at least one location on an exterior surface of the cover, thereby adapting the extension to secure the baby in a predetermined position.

(8) In yet a further variant, the attachment device in selected from the group includes tie strings, hook and eye combinations, hooking and looping devices, buttons, snaps and zippers.

(9) In another variant of the invention, the attachment device is located to secure the baby in a first position. The first position attaches the extension at shoulder height for the baby. The first position constrains the arms of the baby.

(10) In still another variant, the attachment device is located to secure the baby in a second position. The second position attaches the extension at abdomen height for the baby. The second position permits movement of arms of the baby.

(11) In yet another variant, the irregular star-shaped pillow further includes an electrically operated vibrating element. The element causes the device to provide a soothing vibration to induce sleep in the baby.

(12) In a further variant, the irregular star-shaped pillow further includes at least one loudspeaker and electrically operated sound source. The sound source provides music to provide a calming environment for the baby.

(13) In still a further variant, a combination fastening and carrying strap is provided. The strap serves to hold the device in a compact bundle and to provide a carrying handle. The strap is attached to the removable cover with any of stitching, snaps, hook and eye combinations, buttons, snaps, looping and hooking fasteners and zippers.

(14) In yet a further variant, the removable cover includes a plurality of attachment devices. The attachment devices secure the elongated star-point shaped extensions about the irregular star-shaped pillow in a compact bundle.

(15) In another variant of the invention, the adjustable combination fastening and carrying strap provides a mounting for baby toys and accessories and is adapted to secure the baby to the irregular star-shaped pillow.

(16) In still another variant, the elongated star-point shaped extension of the cover is adapted to provide a privacy shield during nursing.

(17) In yet another variant, the baby handling device further includes a carrying bag. The bag is sized and shaped to enclose any of the removable, washable pillow cover, said irregular star-shaped pillow and baby supplies.

(18) In a further variant, a carrying strap is provided.

(19) In still a further variant, the carrying bag further includes at least one pocket.

(20) In yet a further variant, a baby handling device, includes a removable, washable pillow cover. The cover is sized and shaped to fit over and extend from an irregular star-shaped pillow and provides at least two elongated star-point shaped extensions. The extensions are formed of flexible material and adapted to fold over and enclose at least a portion of two babies positioned on the cover. An upper portion of the cover is adapted to support and control movement of heads of two babies when the elongated star-point shaped extensions are wrapped around the babies and fastened to an outer surface of the cover. The cover has a closeable opening sized and shaped to permit insertion and removal of the pillow.

(21) In another variant of the invention, an irregular star-shaped pillow is provided. The pillow is formed of resilient material and includes a broad center section with first and second depressions. The depressions are located on either side of a centerline of the pillow. Each depression is sized and shaped to receive a baby's head. A central point-shaped portion extends upwardly from the depressions. The star-shaped portion is adapted to lodge under an arm of a breast feeding mother. First and second side portions of the pillow are provided. The side portions surround a cavity. The cavity is sized and shaped to receive the shoulders and torsos of two babies. The side portions are sized and shaped to support a baby's arms. A central dividing portion extends downwardly from a lower portion of the broad center section and divides the cavity into two spaces. The dividing portion is adapted to prevent interference between the two babies.

(22) In still another variant, the irregular star-shaped pillow further includes at least one fastening device and the cover includes at least one mating fastening device for securing the pillow within the cover.

(23) In yet another variant, the fastening device is selected from the group includes tie strings, hook and eye combinations, hooking and looping devices, buttons, snaps and zippers.

(24) In a further variant, the irregular star-shaped pillow is formed of impermeable material.

(25) In still a further variant, the removable cover further includes a storage pocket.

(26) In yet a further variant, at least one attachment device is provided. The attachment device provides attachment for a distal end of the elongated star-point shaped extension to at least one location on an exterior surface of the cover, thereby adapting the extension to secure the babies in a predetermined position.

(27) In another variant of the invention, the attachment device is selected from the group that includes tie strings, hook and eye combinations, hooking and looping devices, buttons, snaps and zippers.

(28) In still another variant, the attachment device is located to secure at least one baby in a first position. The first position attaches the extension at shoulder height for the baby. The first position constrains the arms of the baby.

(29) In yet another variant, the attachment device is located to secure at least one baby in a second position. The second position attaches the extension at abdomen height for the baby. The second position permits movement of the arms of the babies.

(30) In a further variant, the irregular star-shaped pillow further includes an electrically operated vibrating element. The element causes the device to provide a soothing vibration to induce sleep in the babies.

(31) In still a further variant, the irregular star-shaped pillow further includes at least one loudspeaker and electrically operated sound source. The sound source provides music to provide a calming environment for the babies.

(32) In yet a further variant, a combination fastening and carrying strap is provided. The strap serves to hold the device in a compact bundle and to provide a carrying handle. The strap is attached to the removable cover with any of stitching, snaps, hook and eye combinations, buttons, looping and hooking fasteners and zippers.

(33) In another variant of the invention, the removable cover includes a plurality of attachment devices. The attachment devices secure the elongated star-point shaped extensions about the irregular star-shaped pillow in a compact bundle.

(34) In still another variant, the adjustable combination fastening and carrying strap provides a mounting for baby toys and accessories and is adapted to secure the babies to the irregular star-shaped pillow.

(35) In yet another variant, the elongated star-point shaped extension of the cover is adapted to provide a privacy shield during nursing.

(36) In a further variant, the baby handling device further includes a carrying bag. The bag is sized and shaped to enclose any of the removable, washable pillow cover, the irregular star-shaped pillow and baby supplies.

(37) In still a further variant, a carrying strap is provided.

(38) In, a final variant of the invention, the carrying bag further includes at least one pocket.

An appreciation of the other aims and objectives of the present invention and an understanding of it may be achieved by referring to the accompanying drawings and the detailed description of a preferred embodiment.

DESCRIPTION OF THE DRAWINGS

FIG. 46 is a plan view of the FIG. 37 embodiment illustrating two babies secured in a prone position;

FIG. 47 is a perspective view of the FIG. 37 embodiment illustrating two babies secured in a prone position;

FIG. 50 is a perspective view of the FIG. 37 embodiment secured in a compact bundle with the attachment devices and the combination fastening and carrying strap; and FIG. 51 is a perspective view of a carrying bag for the FIG. 37 embodiment.

DETAILED DESCRIPTION OF THE PREFERRED EMBODIMENT (1) FIGS. 1-16 illustrate a baby handling device 10 that may be constructed from the following components. As illustrated in FIGS. 1-5, a horseshoe-shaped pillow 14 is provided. The pillow 14 is formed of resilient material 16, has a center section 18 of a first height 22 and adjacent first 26 and second 30 side sections that taper to opposite first 34 and second 38 ends of a second, lower height 42. A removable, washable cover 54 is provided. The cover 54 is sized and shaped to fit over the horseshoe-shaped pillow 14 and provides a support platform 46. The platform 46 is formed of flexible material 50 and extends between an upper surface 48 of the center section 18 and at least a portion of upper surfaces 52, 56 of the side sections 26, 30 said support platform becoming concave when supporting a baby. (See FIGS. 3A-3C) A restraining blanket 58 is provided. The blanket 58 is formed of flexible material 62 and is removably and adjustably attached to at least an underside 66 and a top surface 70 of the cover 54 of the horseshoe-shaped pillow 14. The horseshoe-shaped pillow 14 provides support for a baby's head 74 and neck 78. The support platform 46 provides a determined position 60 for the baby's body 82 (See FIGS. 3B and 3C) and the restraining blanket 58 constrains movement of the baby's arms 86.

Figure 1:
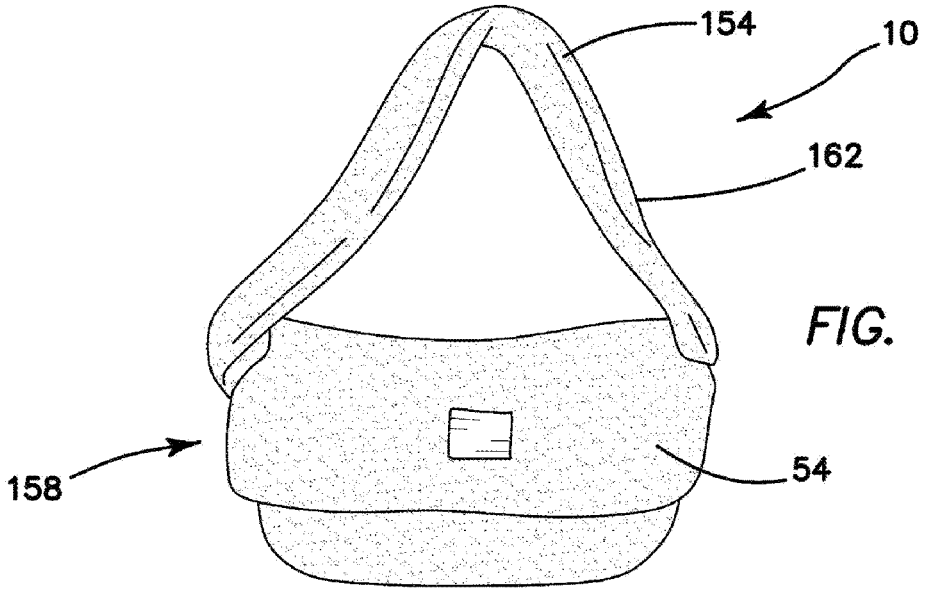
FIG. 1 is a perspective view of the preferred embodiment of the invention illustrating the baby handling device secured in a compact bundle with attached carrying strap.
Figure 2:
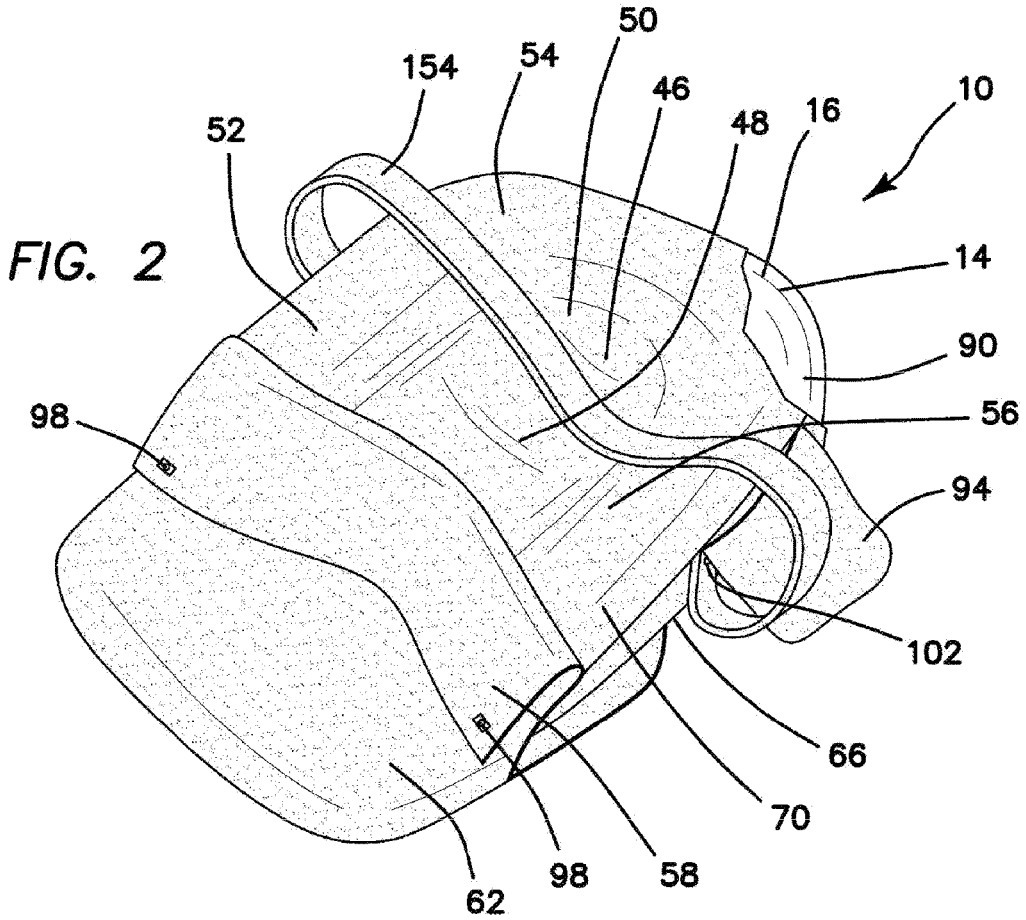
FIG. 2 is a partially broken out perspective view of the FIG. 1 embodiment illustrating the horseshoe-shaped pillow, washable cover, restraining blanket, combination fastening and carrying strap and storage pocket.
Figure 2A:
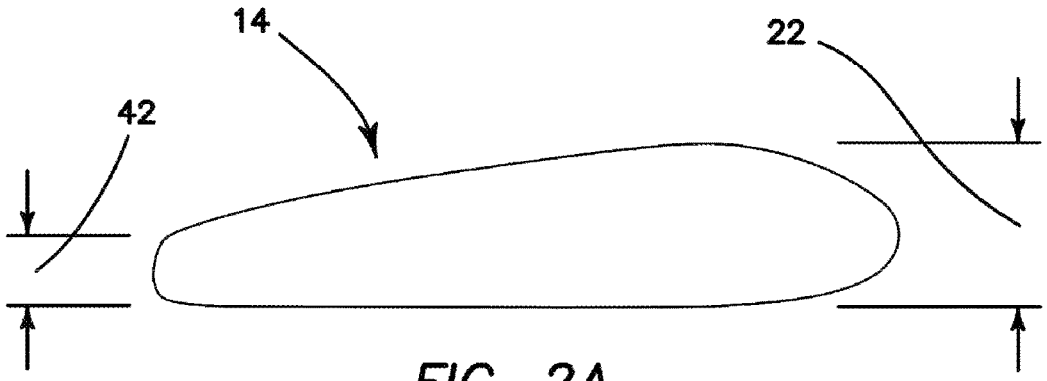
FIG. 2A is a side elevational view of the horseshoe-shaped pillow illustrating the relative heights of the center and side sections.
Figure 2B:
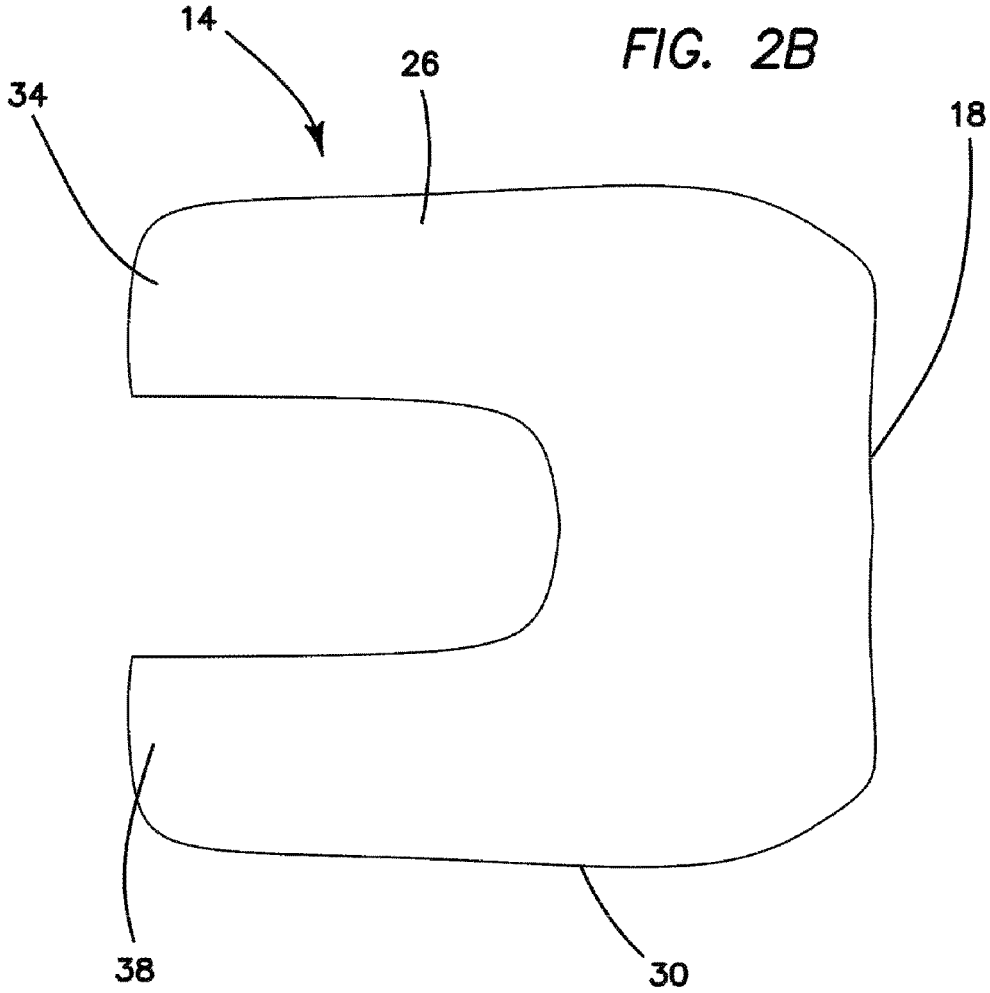
FIG. 2B is a plan view of the horseshoe-shaped pillow illustrating the shape of the pillow.
Figure 3:
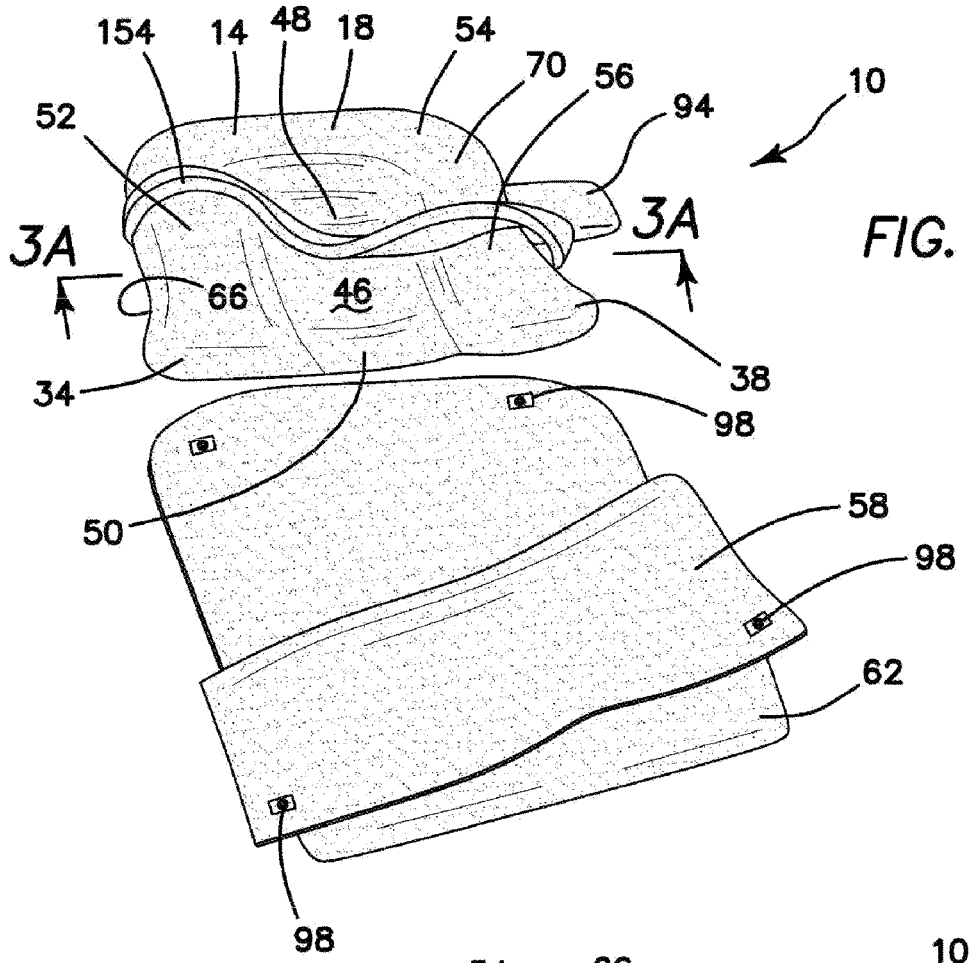
FIG. 3 is a perspective view of the FIG. 2 embodiment illustrating the horseshoe-shaped pillow within the washable cover and the restraining blanket with fastening devices.
Figure 4:
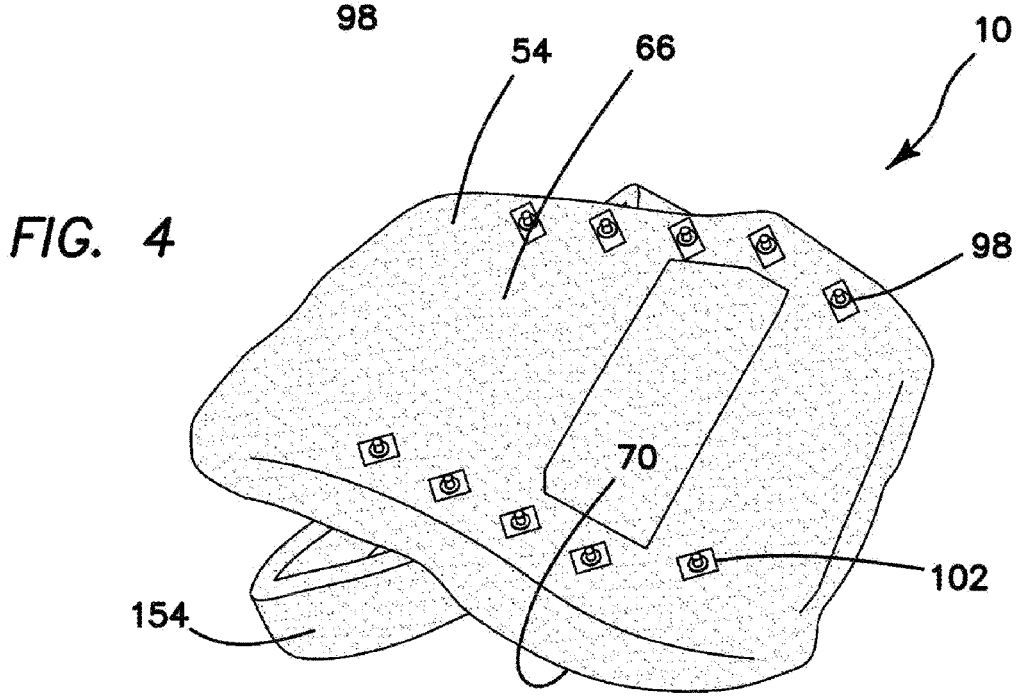
FIG. 4 is a perspective view of the FIG. 2 embodiment illustrating the underside of the washable cover and the plurality of fastening devices for use with the sleeping bag configuration of the device.
Figure 3A:
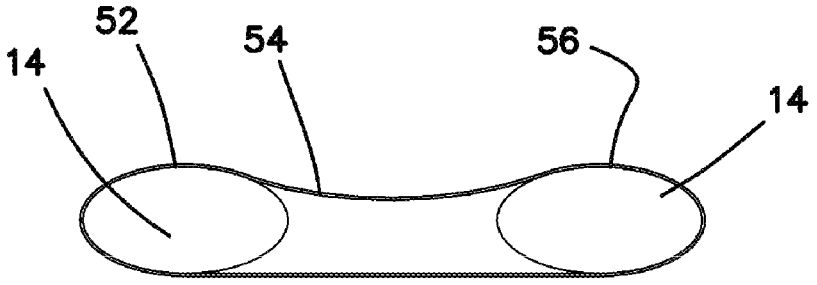
FIG. 3A is a cross-sectional view of the horseshoe-shaped pillow and washable cover of the FIG. 2 embodiment.
Figure 3B:
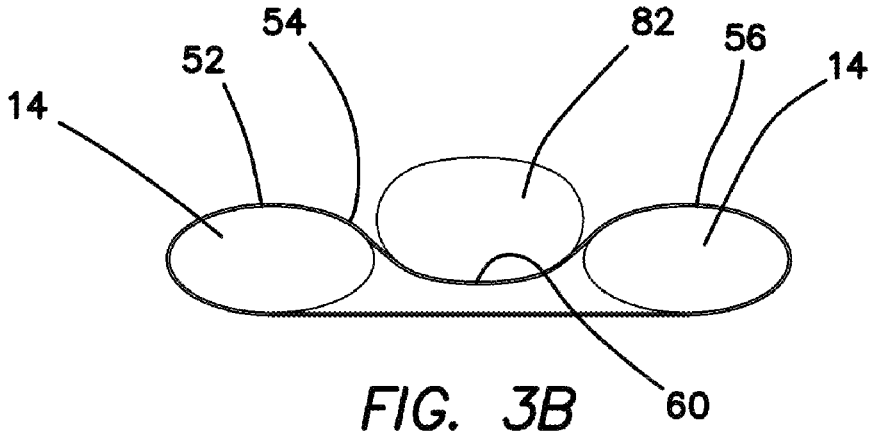
FIG. 3B is a cross-sectional view of the FIG. 2 embodiment with a baby in place on the horseshoe-shaped pillow.
Figure 3C:
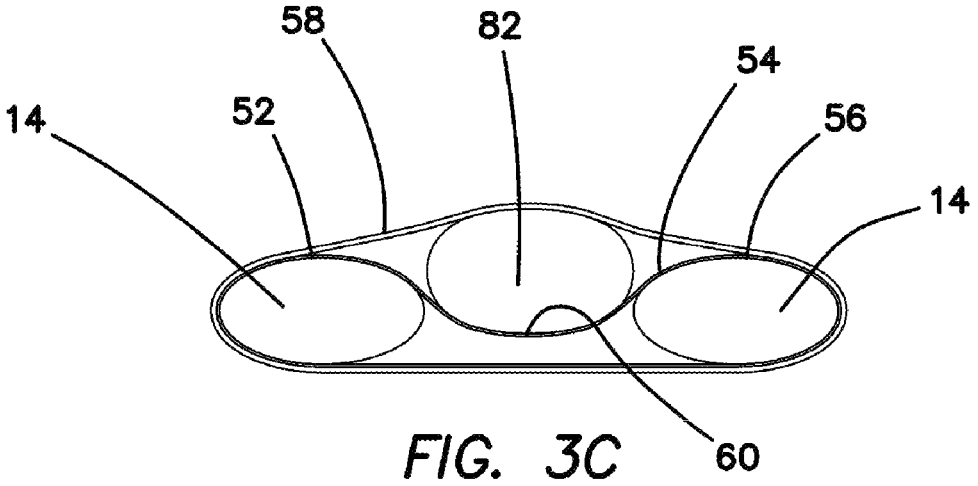
FIG. 3C is a cross-sectional view of the FIG. 2 embodiment with a baby in place on the horseshoe-shaped pillow constrained by the blanket.

(2) In a variant of the invention, the horseshoe-shaped pillow 14 is formed of impermeable material 90.

(3) In another variant, the removable cover 54 further includes a storage pocket 94.

(4) In still another variant, the restraining blanket 58 is attached to the removable cover 54 with a plurality of fastening devices 98 selected from the group that includes snaps 102, hook and eye combinations (not shown), buttons (not shown), looping and hooking fasteners (not shown) and zippers (not shown).

Figure 6:
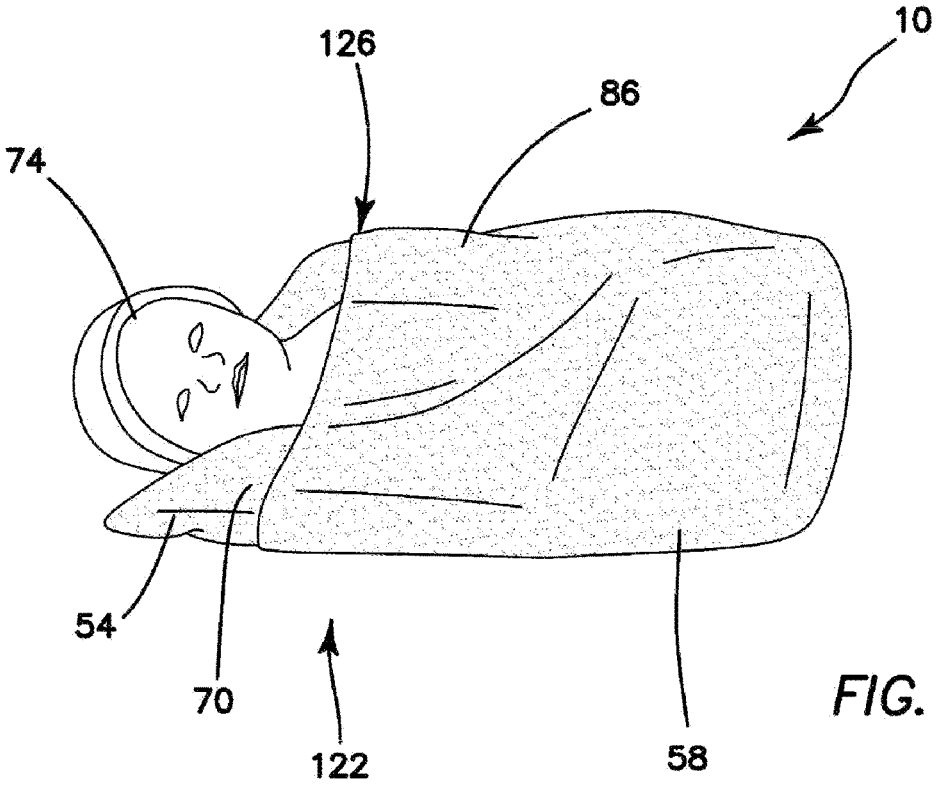
FIG. 6 is a perspective view of the FIG. 2 embodiment illustrating the restraining blanket attached in a first position for swaddling a baby.
Figure 6A:
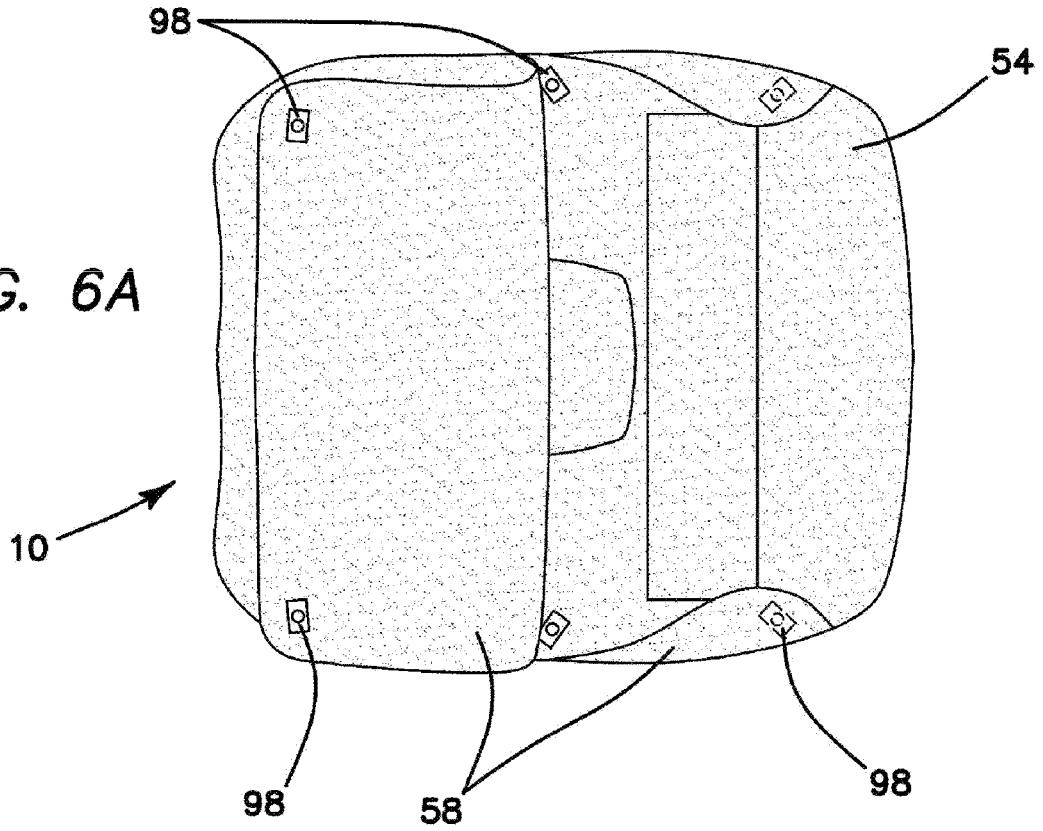
FIG. 6A is a rear perspective view of the FIG. 2 embodiment illustrating the restraining blanket attached in a first position for swaddling a baby.

(5) In yet another variant, as illustrated in FIG. 6, the fastening devices 98 provide attachment for the restraining blanket 58 at a first position 122. The first position 122 attaches the blanket 58 at approximately shoulder height 126 for a baby on at least the underside 66 of the removable cover 54. The first position 122 constrains the arms 86 of the baby.

Figure 7B:
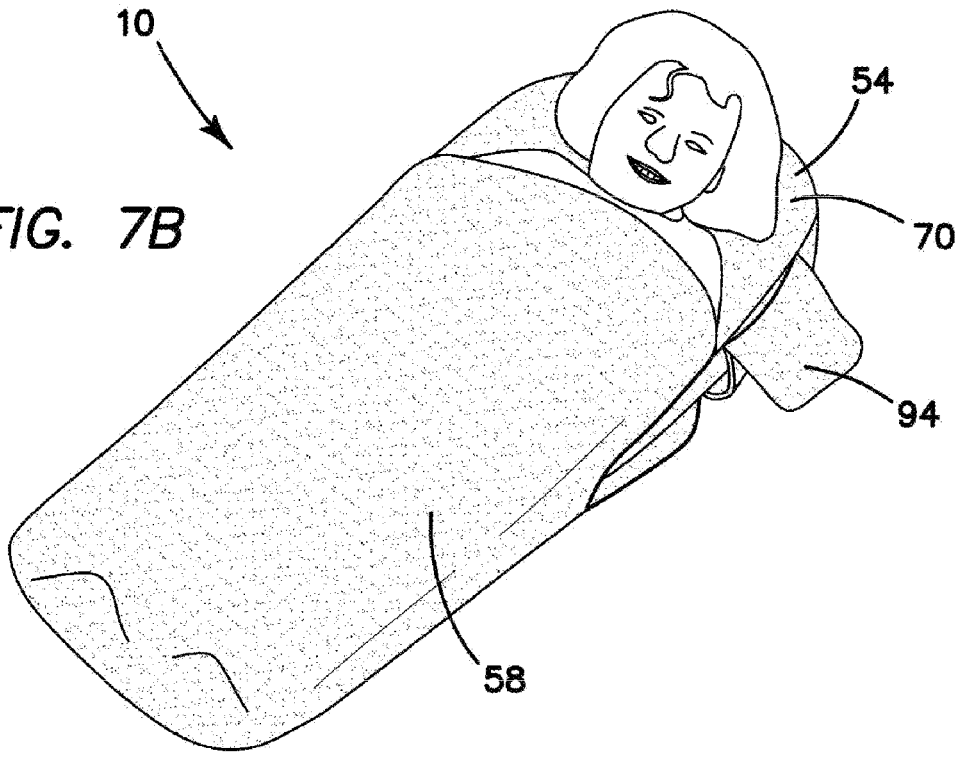
FIG. 7B is a perspective view of the FIG. 2 embodiment illustrating the restraining blanket attached to the washable cover to provide a sleeping bag configuration for a larger child.
Figure 7:
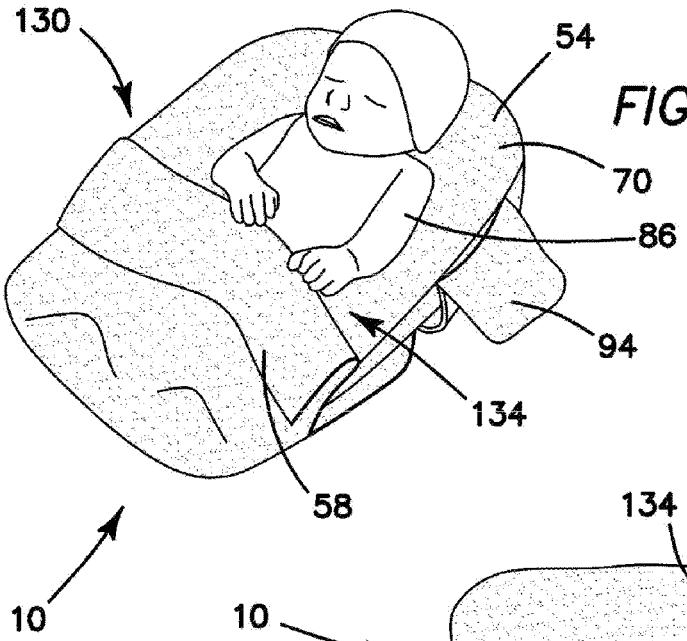
FIG. 7 is a perspective view of the FIG. 2 embodiment illustrating the restraining blanket attached to the washable cover to provide a sleeping bag configuration for the device.

(6) In a further variant, as illustrated in FIG. 7, the fastening devices 98 provide attachment for the restraining blanket 58 at a second position 130. The second position 130 attaches the blanket 58 at approximately abdomen height 134 for a baby on at least the underside 66 of the removable cover 54. The second position 130 permits movement of arms 86 of the baby.

Figure 7A:
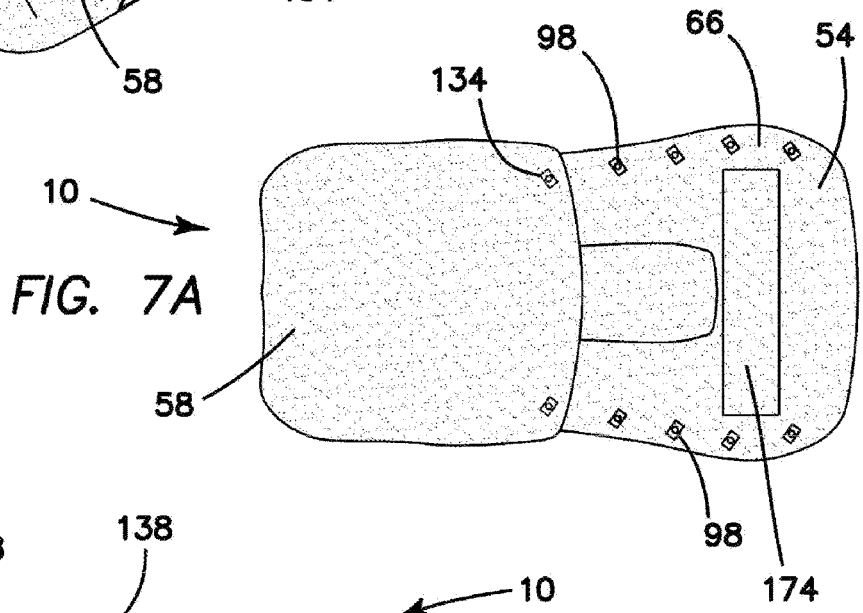
FIG. 7A is a plan view of the underside of the FIG. 2 embodiment illustrating the variable attachment of the blanket to the removable cover.
Figure 8:
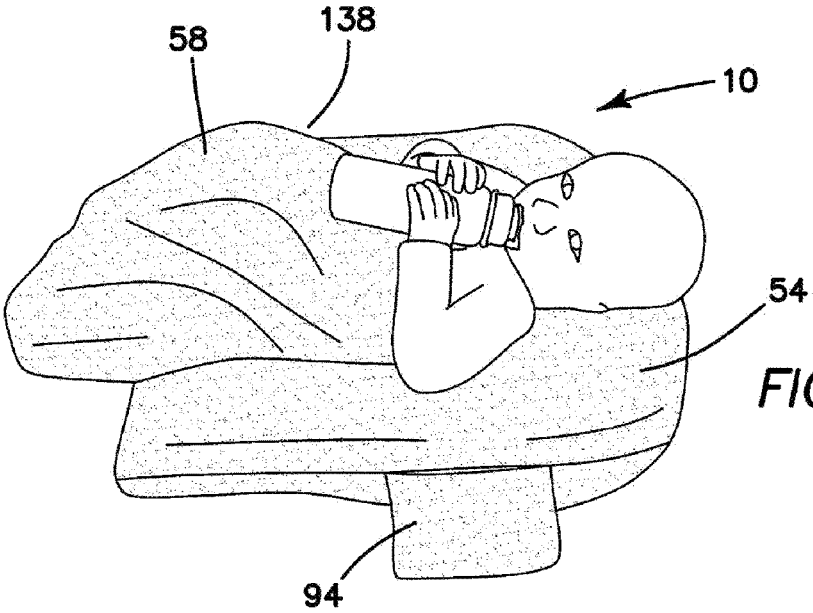
FIG. 8 is a perspective view of the FIG. 2 embodiment illustrating the restraining blanket detached from the washable cover and wrapped about the baby in a bottle feeding configuration for the device.
Figure 9:
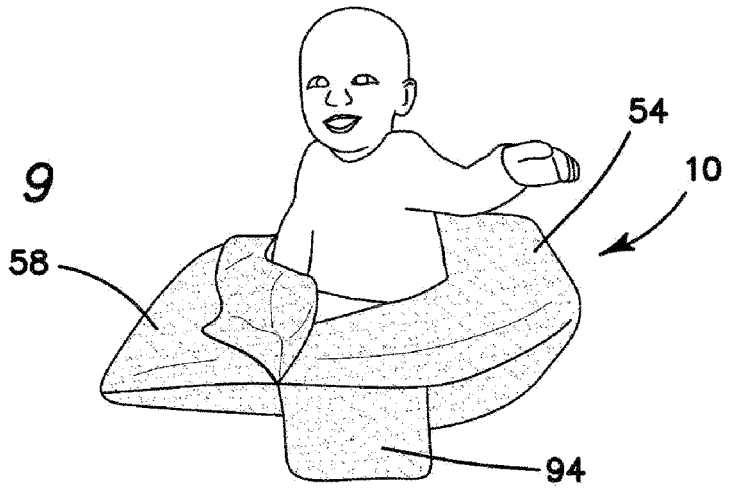
FIG. 9 is a perspective view of the FIG. 2 embodiment illustrating the device used as a support for a baby in a sitting position.

(7) In still a further variant, as illustrated in FIGS. 7A and 8, the fastening devices 98 provide attachment for the restraining blanket 58 at a series of points 134 on the underside 66 of the removable cover 54, permitting use of the device 10 as a sleeping bag 138 for a baby of increasing height.

Figure 10:
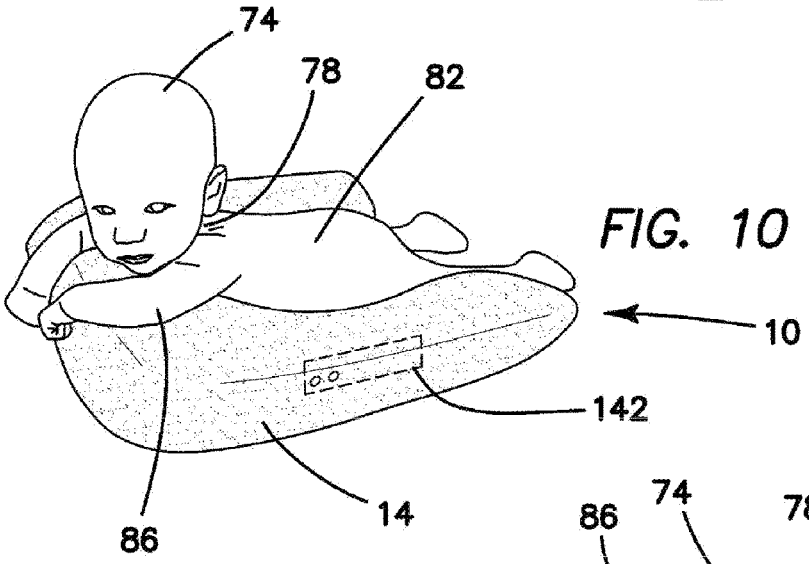
FIG. 10 is a perspective view of the FIG. 2 embodiment illustrating the device used as a support for a baby in a prone position and illustrating a vibrating element for the horseshoe-shaped pillow.

(8) In yet a further variant, as illustrated in FIG. 10, the horseshoe-shaped pillow 14 further includes an electrically operated vibrating element 142. The vibrating element 142 causes the device 10 to provide a soothing vibration to the device 10 to induce sleep in a baby.

Figure 11:
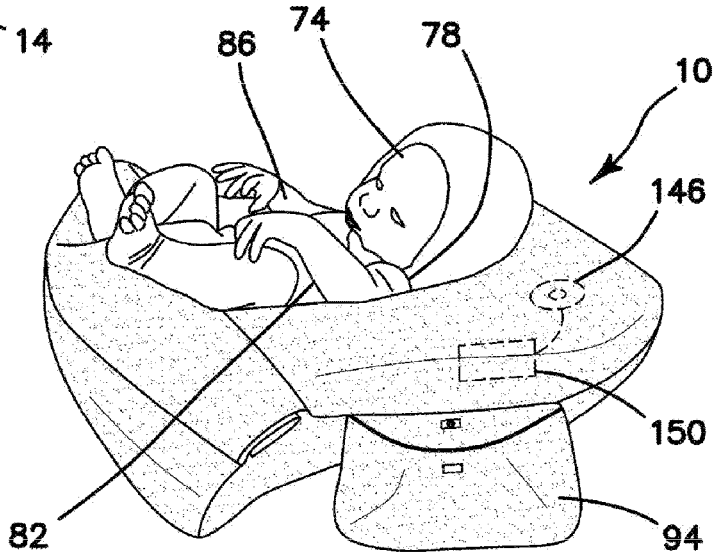
FIG. 11 is a perspective view of the FIG. 2 embodiment illustrating the device used as a support for a baby in a dorsal position and illustrating a music source and speaker system for the horseshoe-shaped pillow.

(9) In another variant of the invention, as illustrated in FIG. 11, the horseshoe-shaped pillow 14 further includes at least one loudspeaker 146 and electrically operated music source 150. The music source 150 provides music to provide a calming environment for a baby.

(10) In still another variant, as illustrated in FIGS. 1-5, a combination fastening and carrying strap 154 is provided. The strap 154 serves to hold the device 10 in a compact bundle 158 and to provide a carrying handle 162. The strap 154 is attached to either the removable cover 54 or the restraining blanket 58 with any of stitching (not shown) snaps 102, hook and eye combinations (not shown), buttons (not shown), looping and hooking fasteners (not shown) and zippers (not shown).

(11) In yet another variant, the restraining blanket 58 includes a plurality of fastening devices 98. The fastening devices 98 secure the blanket 58 about the horseshoe-shaped pillow 14 in a compact bundle 158. The combination fastening and carrying strap 154 provides a carrying handle 162 for the bundle 158.

Figure 13:
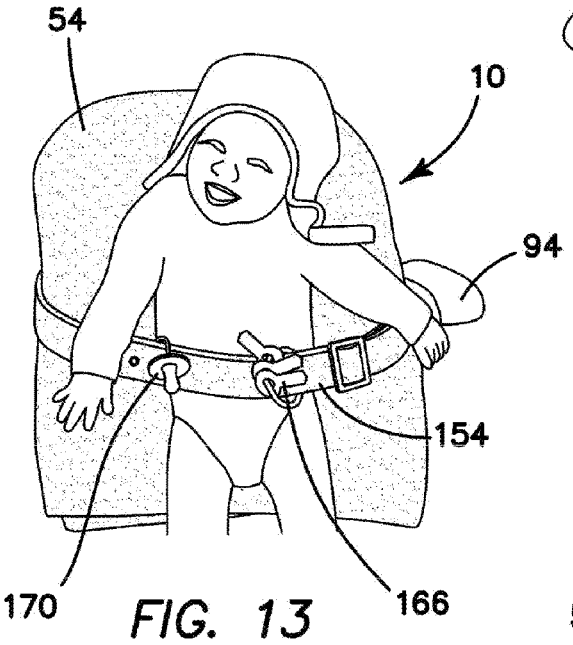
FIG. 13 is a perspective view of the FIG. 2 embodiment illustrating the device with the adjustable combination fastening and carrying strap providing a mounting for baby toys and accessories.
Figure 14:
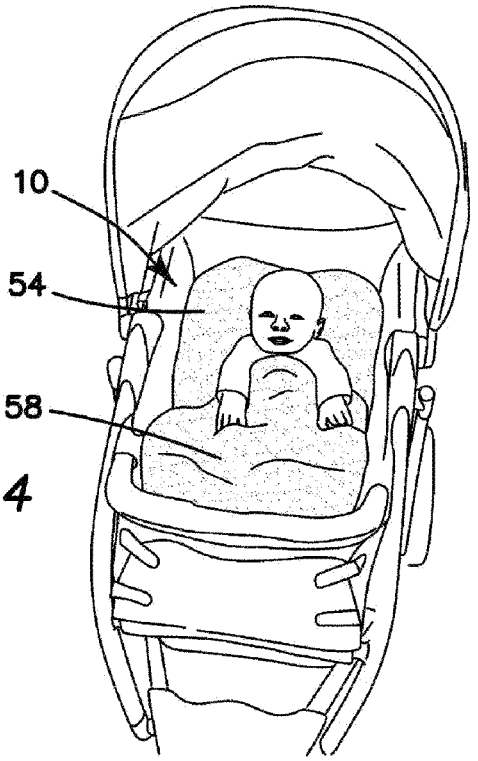
FIG. 14 is a perspective view of the FIG. 2 embodiment illustrating the device used as a support for a baby within a baby carriage.
Figure 13A:
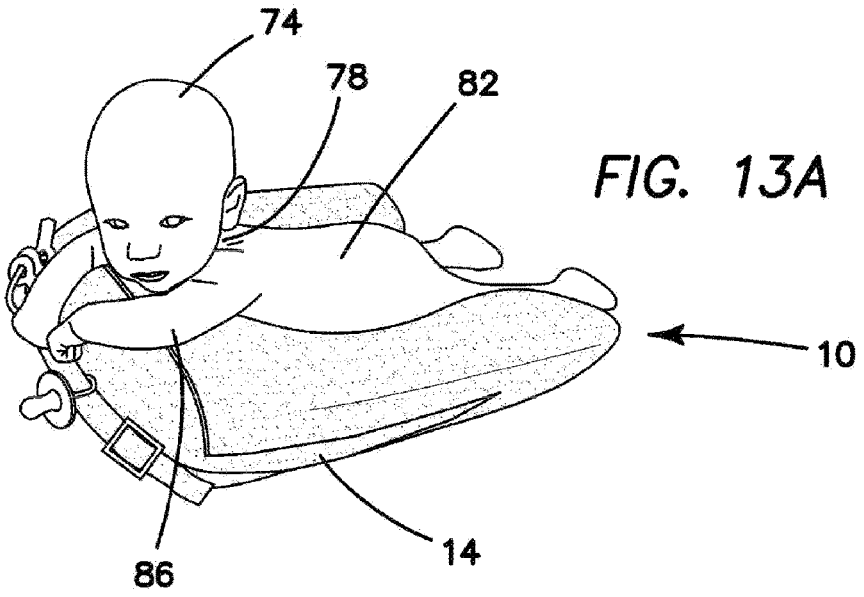
FIG. 13A is a perspective view of the FIG. 2 embodiment illustrating the baby in a prone position on top of the blanket with the adjustable combination fastening and carrying strap holding baby toys and accessories in position for use by the baby.
Figure 16:
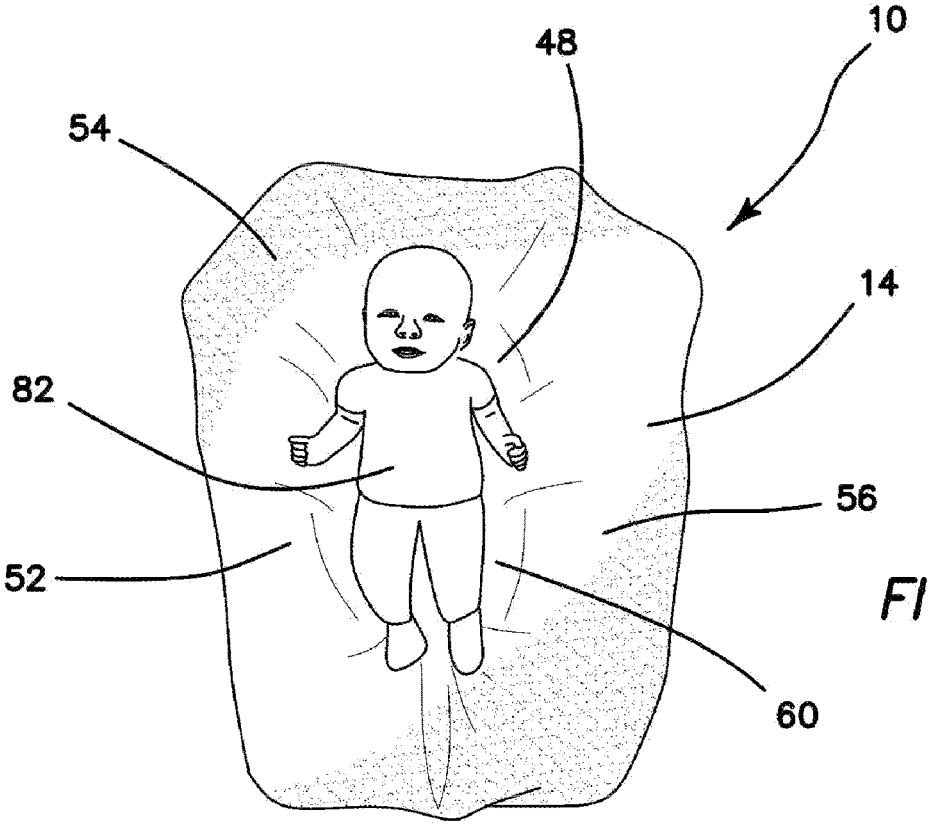
FIG. 16 is a plan view of the FIG. 2 embodiment illustrating the determined position of the baby on the device.
Figure 15:
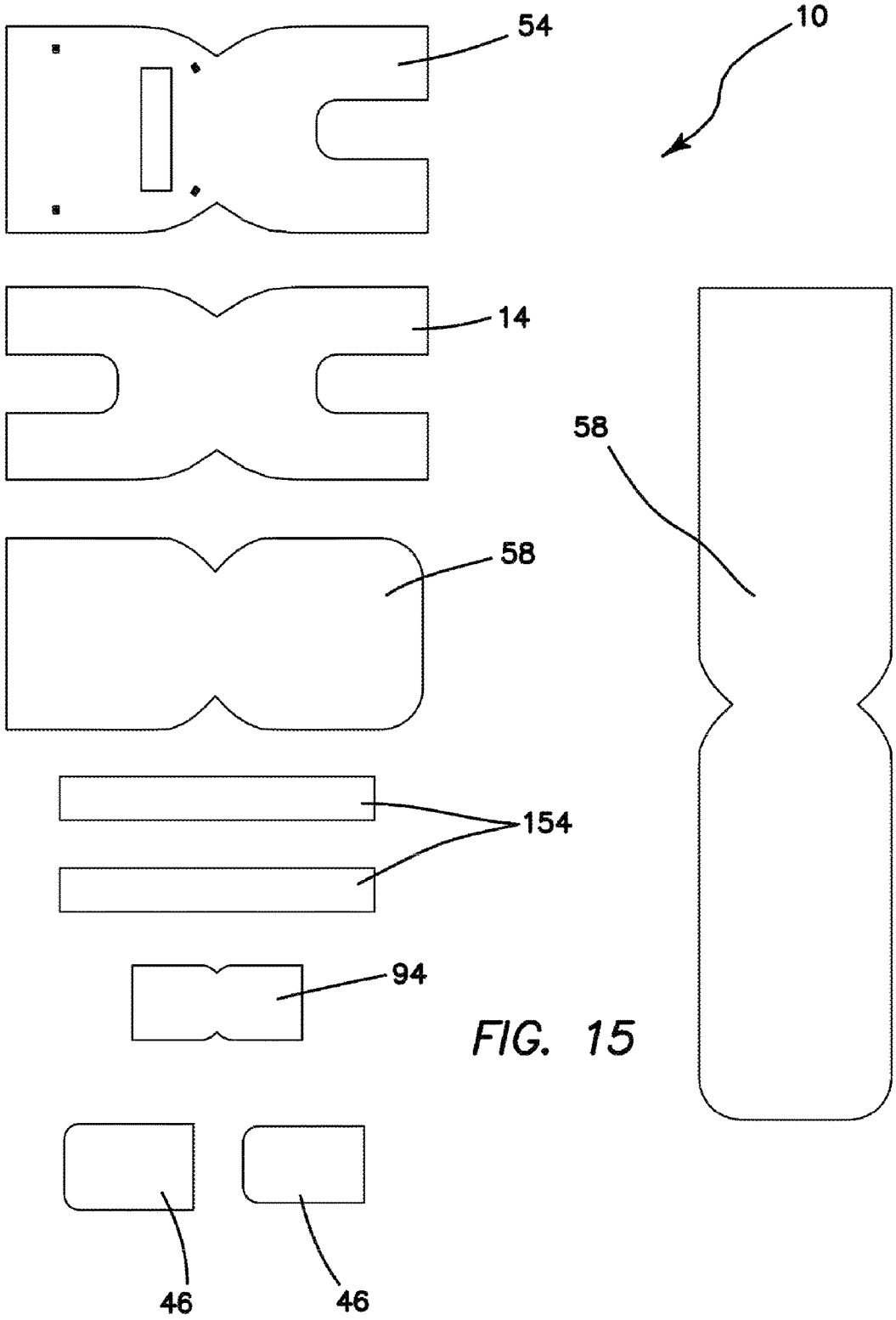
FIG. 15 is a plan view of fabric patterns used to make the baby handling device.

(12) In another variant of the invention, as illustrated in FIGS. 13 and 13A, the adjustable combination fastening and carrying strap 154 provides a mounting for baby toys 166 and accessories 170 and secures the baby to the horseshoe-shaped pillow 14.

Figure 5:
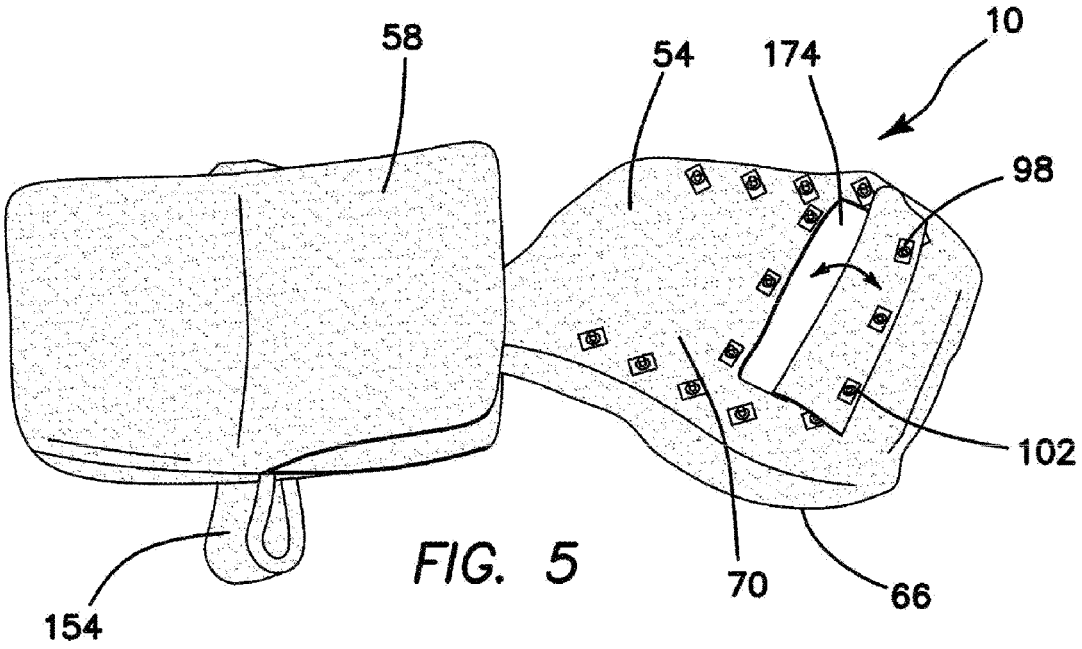
FIG. 5 is a perspective view of the FIG. 2 embodiment illustrating the underside of the washable cover for the horseshoe-shaped pillow and the restraining blanket.

(13) In still another variant, as illustrated in FIGS. 5 and 7A, the removable cover 54 for the horseshoe-shaped pillow 14 further includes a closable opening 174. The opening 174 provides for removal of the horseshoe-shaped pillow 14 from the cover 54.

Figure 12:
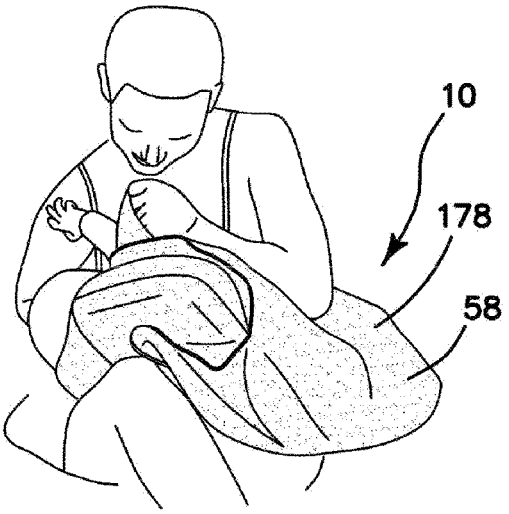
FIG. 12 is a perspective view of the FIG. 2 embodiment illustrating the device used as a support for a baby during nursing.

(14) In a final variant of the invention, as illustrated in FIG. 12, the blanket 58 is removed from the cover 54 and provides a privacy shield 178 during nursing.

(1) FIGS. 17A-36 illustrate a baby handling device 200 that may be constructed from the following components. As illustrated in FIGS. 17A-19 and 21, a removable, washable pillow cover 204 is provided. The cover 204 is sized and shaped to fit over and extend from an irregular star-shaped pillow 208 and provides at least two elongated star-point shaped extensions 212. The extensions 212 are formed of flexible material 216 and adapted to fold over and enclose at least a portion of a baby 220 positioned on the cover 204. An upper portion 224 of the cover 204 is adapted to support and control movement of a baby's head 228 when the elongated star-point shaped extensions 212 are wrapped around the baby 220 and fastened to an outer surface 232 of the cover 204. The cover 204 has a closeable opening 236 sized and shaped to permit insertion and removal of the pillow 208.

Figure 25:
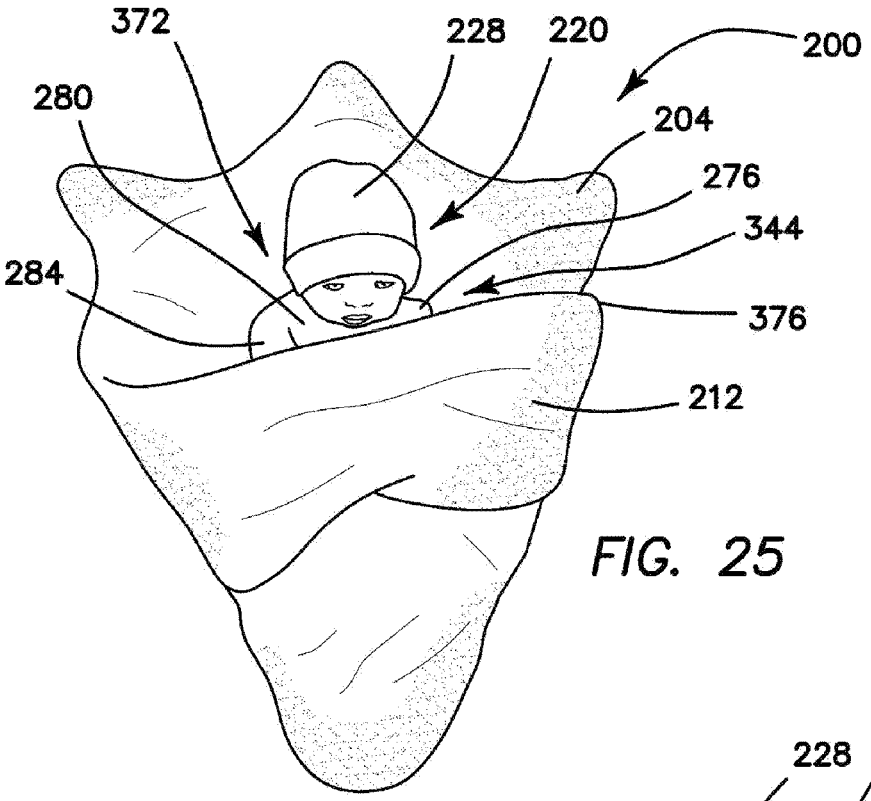
FIG. 25 is a plan view of the FIG. 19 embodiment securing a baby in a first positions with arms secured.
Figure 26:
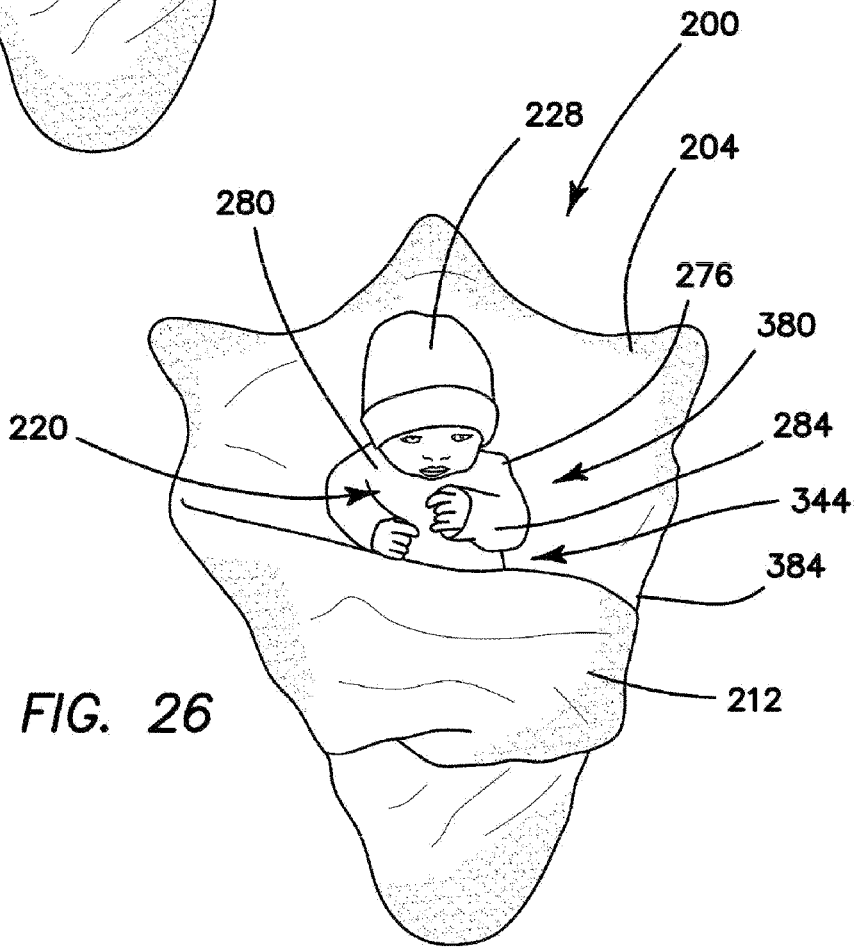
FIG. 26 is a plan view of the FIG. 19 embodiment securing a baby in a second positions with arms unsecured.
Figure 28:
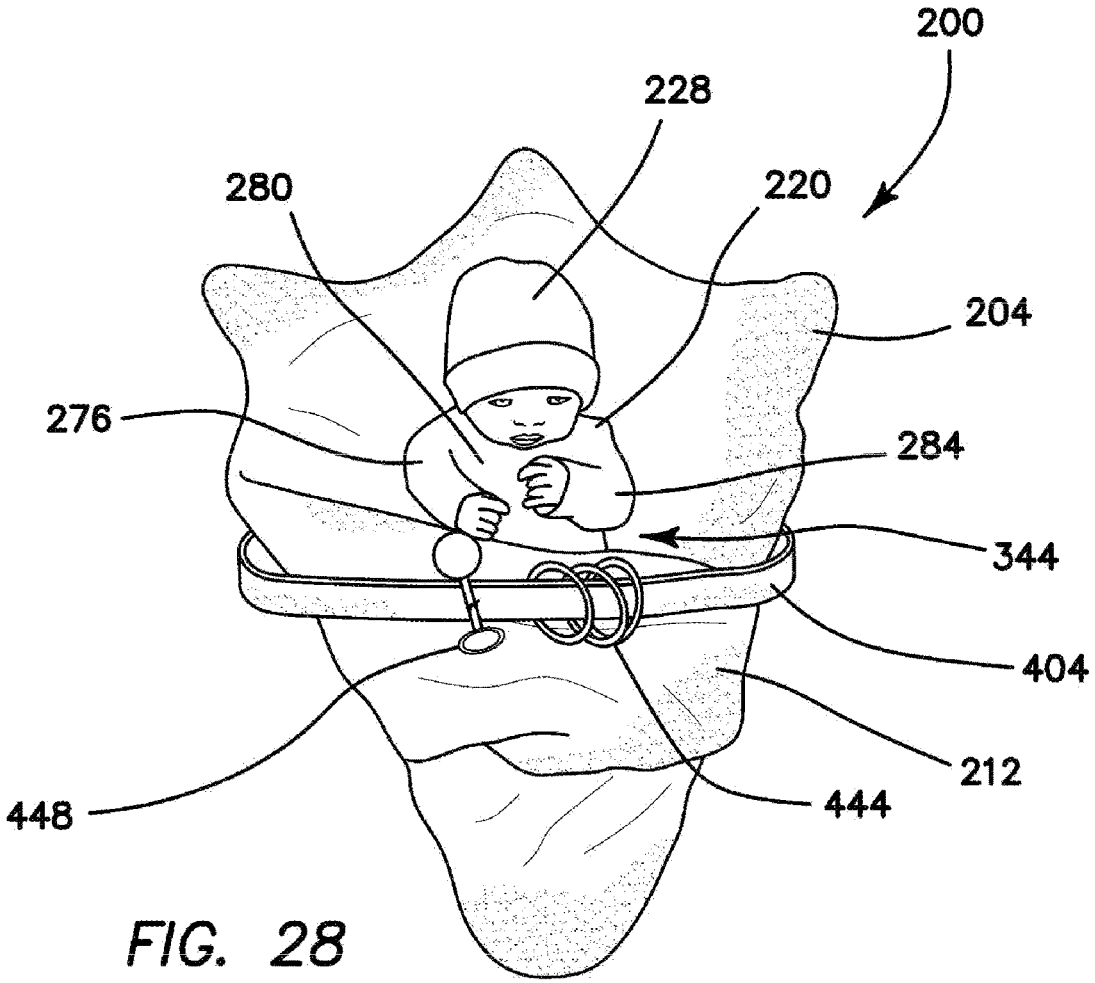
FIG. 28 is a perspective view of the FIG. 19 embodiment securing a baby in the second position with the combination fastening and carrying strap.

(2) In a variant of the invention, an irregular star-shaped pillow 208 is provided. The pillow 208 is formed of resilient material 240 and includes a broad center section 244 with a central depression 248 sized and shaped to receive a baby's head 228. A central point-shaped portion 252 of the pillow 208 extends upwardly from the depression 248. The star-shaped portion 252 is adapted to lodge under an arm 256 of a breast feeding mother 260. The pillow 208 includes first 264 and second 268 side portions. The side portions 264, 268 surround a cavity 272. The cavity 272 is sized and shaped to receive the shoulders 276 and torso 280 of the baby 220. As illustrated in FIGS. 25, 26 and 28, the side portions 264, 268 are sized and shaped to support a baby's arms 284.

(3) In another variant, as illustrated in FIGS. 18, 19, 20A and 20B, the irregular star-shaped pillow 208 further includes at least one fastening device 288 and the cover 204 includes at least one mating fastening device 292 for securing the pillow 208 within the cover 204.

(4) In still another variant, the fastening device 288 is selected from the group includes tie strings 296, hook and eye combinations (not shown), hooking and looping devices 304, buttons (not shown), snaps (not shown) and zippers (not shown).

(5) In yet another variant, the irregular star-shaped pillow 208 is formed of impermeable material 320.

Figure 22:
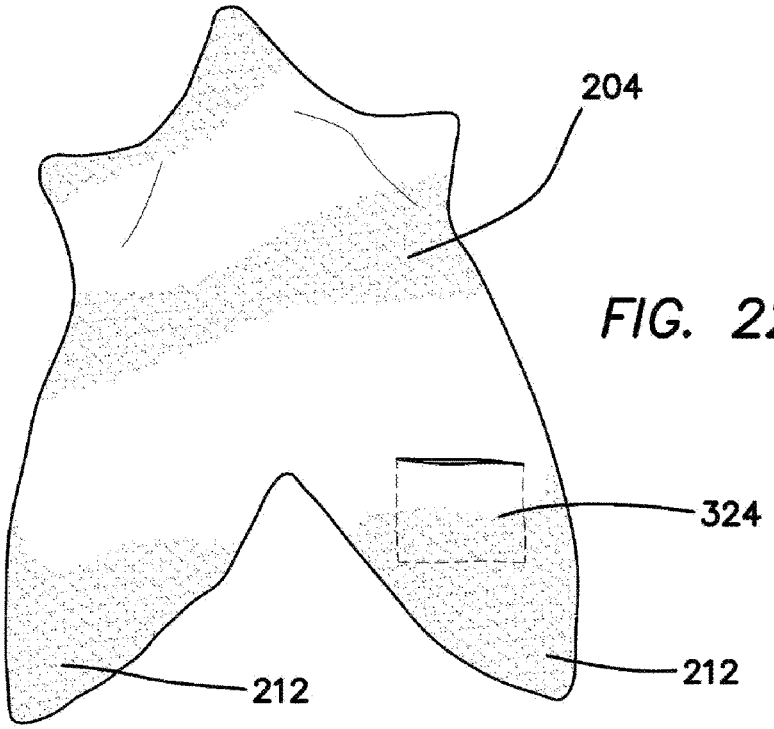
FIG. 22 is a plan view of the FIG. 19 embodiment illustrating an attached pocket.
Figure 23:
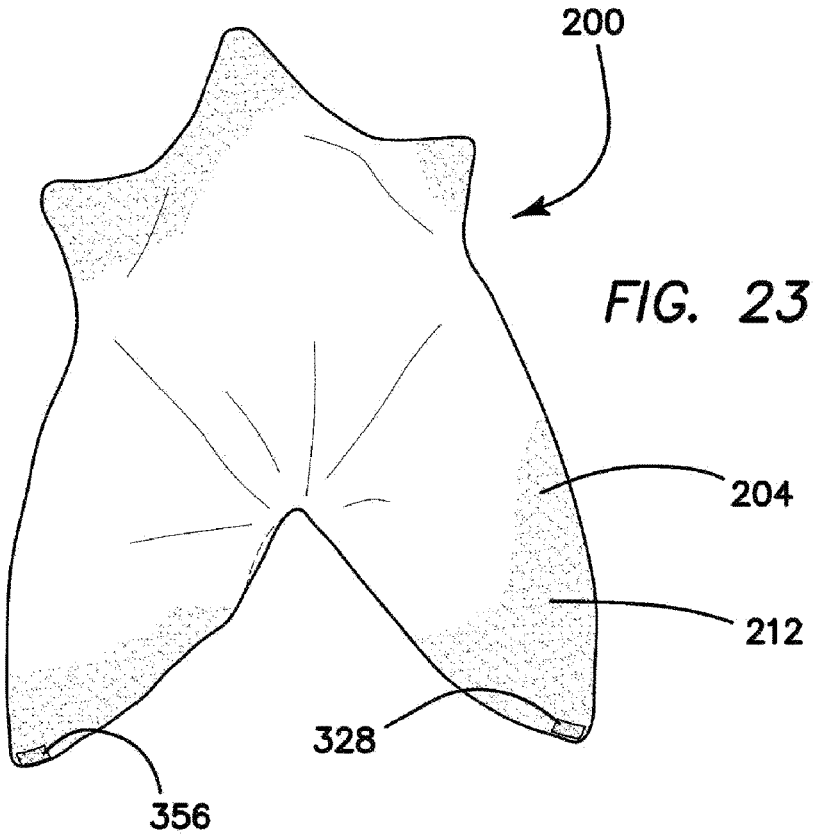
FIG. 23 is a plan view of front side of the FIG. 19 embodiment invention illustrating hooking and looping attachment devices for securing distal ends of elongated star-shaped portions of the cover.
Figure 24:
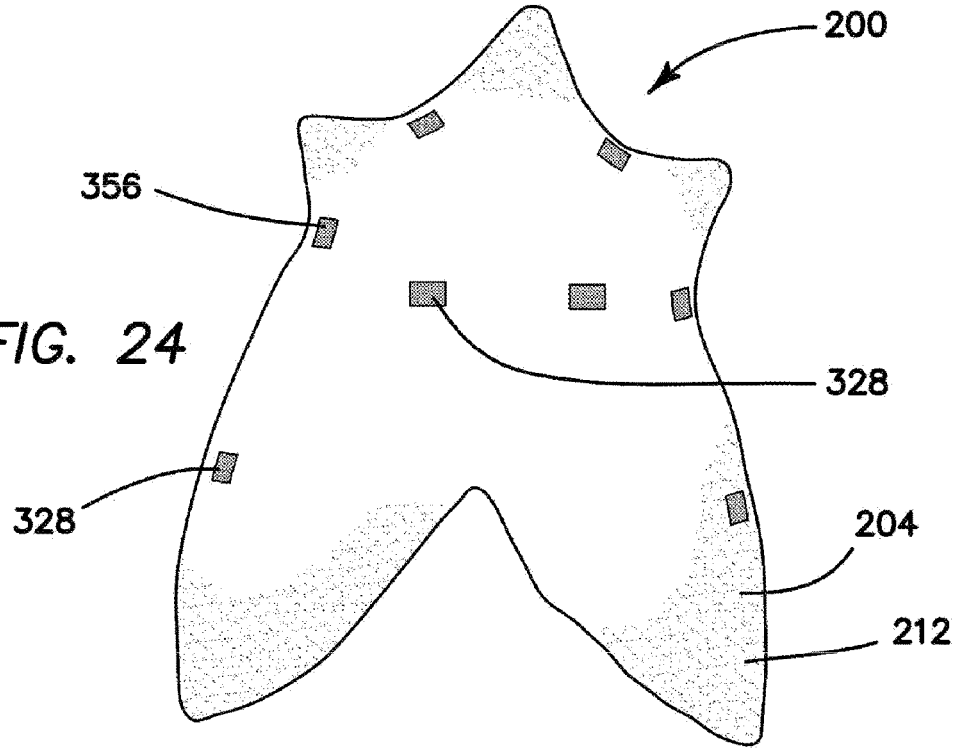
FIG. 24 is a plan view of back side of the FIG. 19 embodiment invention illustrating hooking and looping attachment devices for securing distal ends of elongated star-shaped portions of the cover.

(6) In a further variant, as illustrated in FIG. 22, the removable cover 204 further includes a storage pocket 324.

Figure 17A:
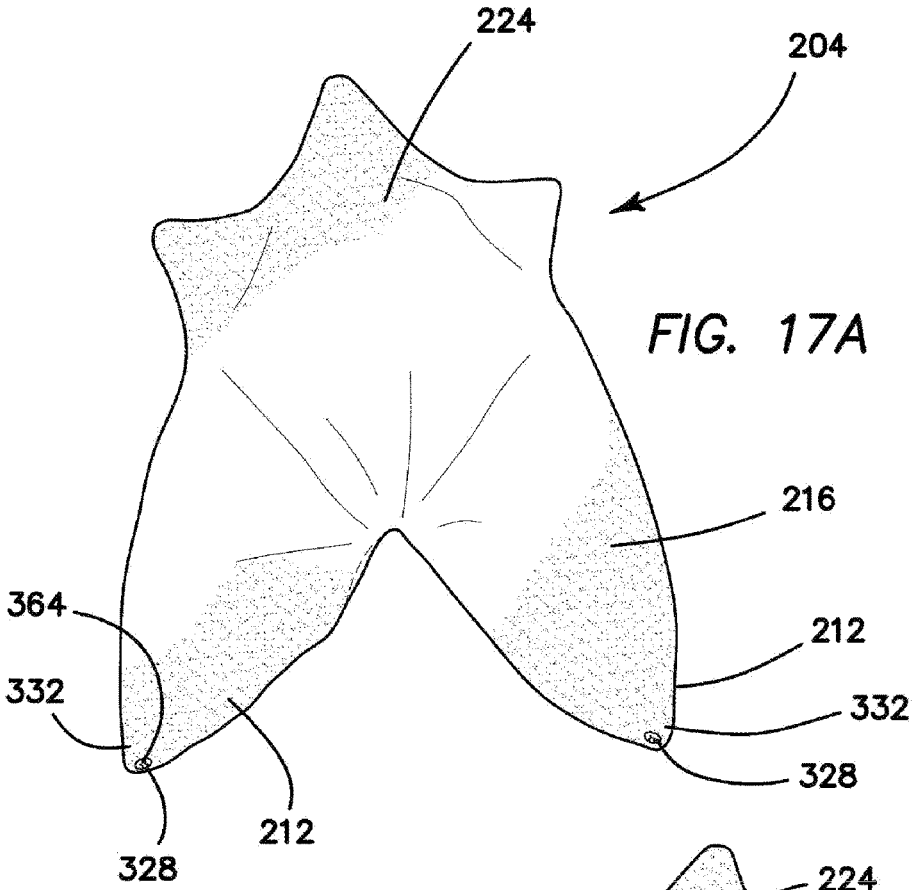
FIG. 17A is a plan view of the front side of a flexible cover for a star-shaped pillow of the Baby Handling Device of the present invention illustrating snap attachment devices for securing distal ends of elongated star-shaped portions of the cover.
Figure 17B:
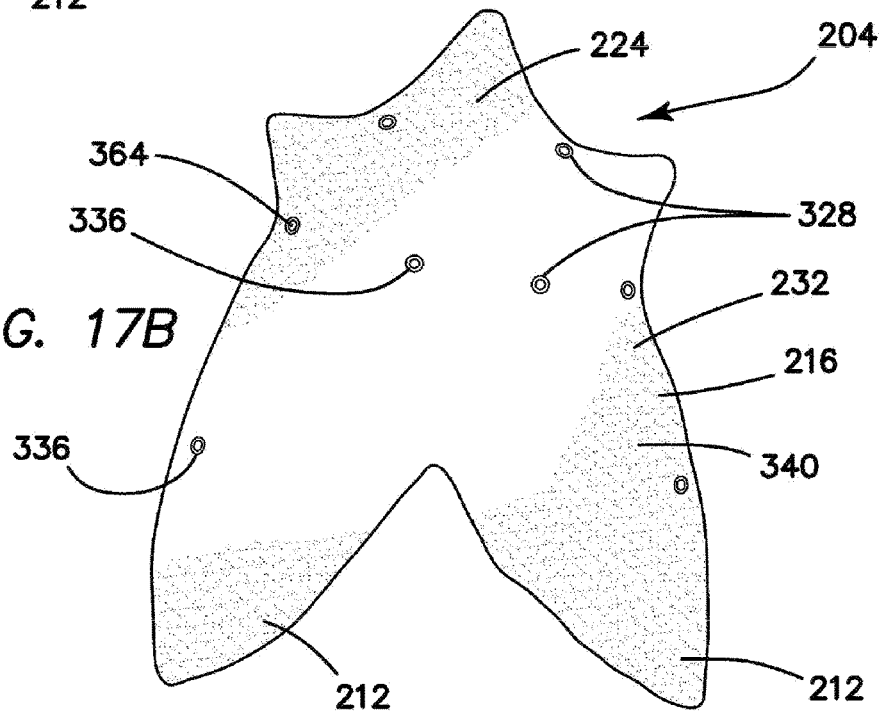
FIG. 17B is a plan view of the back side of the flexible cover of the FIG. 17A embodiment.

(7) In still a further variant, as illustrated in FIGS. 17A and 17B, at least one attachment device 328 is provided. The attachment device 328 provides attachment for a distal end 332 of the elongated star-point shaped extension 212 to at least one location 336 on an exterior surface 340 of the cover 204, thereby adapting the extension 212 to secure the baby 220 in a predetermined position 344 as illustrated in FIGS. 25, 26, 28, 31, and 33-36.

(8) In yet a further variant, as illustrated in FIGS. 17A, 17B, 23, 24 and 31, the attachment device 328 in selected from the group includes tie strings 348, hook and eye combinations (not shown), hooking and looping devices 356, buttons (not shown), snaps 364 and zippers (not shown).

(9) In another variant of the invention, as illustrated in FIG. 25, the attachment device 328 is located to secure the baby 220 in a first position 372. The first position 372 attaches the extension 212 at shoulder height 376 for the baby 220. The first position 372 constrains arms 284 of the baby 220.

(10) In still another variant, as illustrated in FIG. 26, the attachment device 328 is located to secure the baby 220 in a second position 380. The second position 380 attaches the extension 212 at abdomen height 384 for the baby 220. The second position 380 permits movement of arms 284 of the baby 220.

Figure 18:
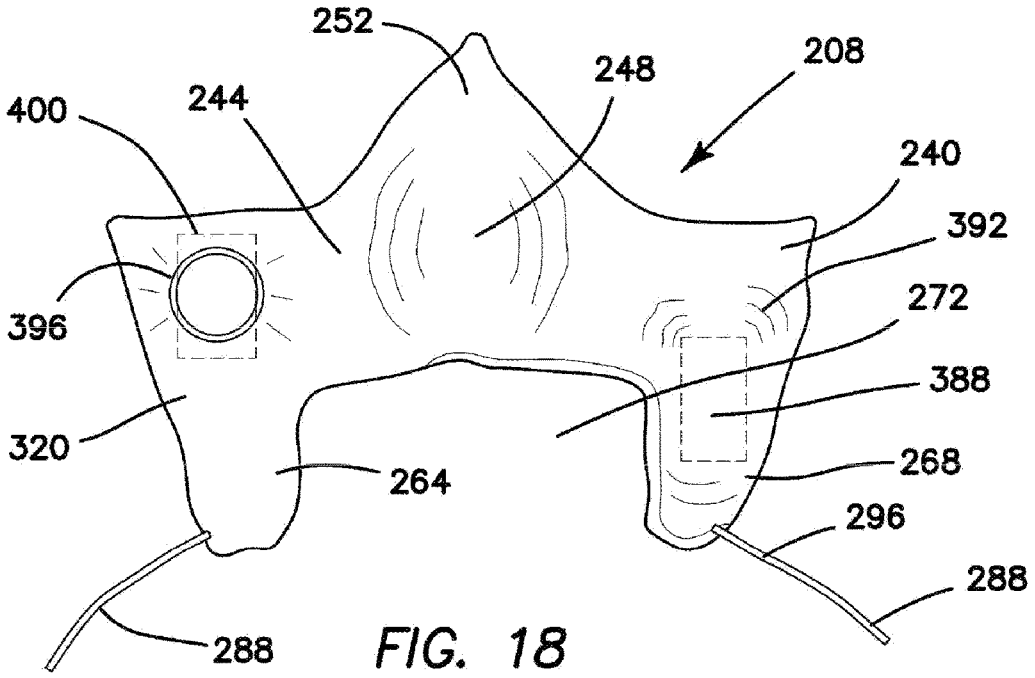
FIG. 18 is a plan view of the star-shaped pillow of the Baby Handling Device of the present invention.
Figure 19:
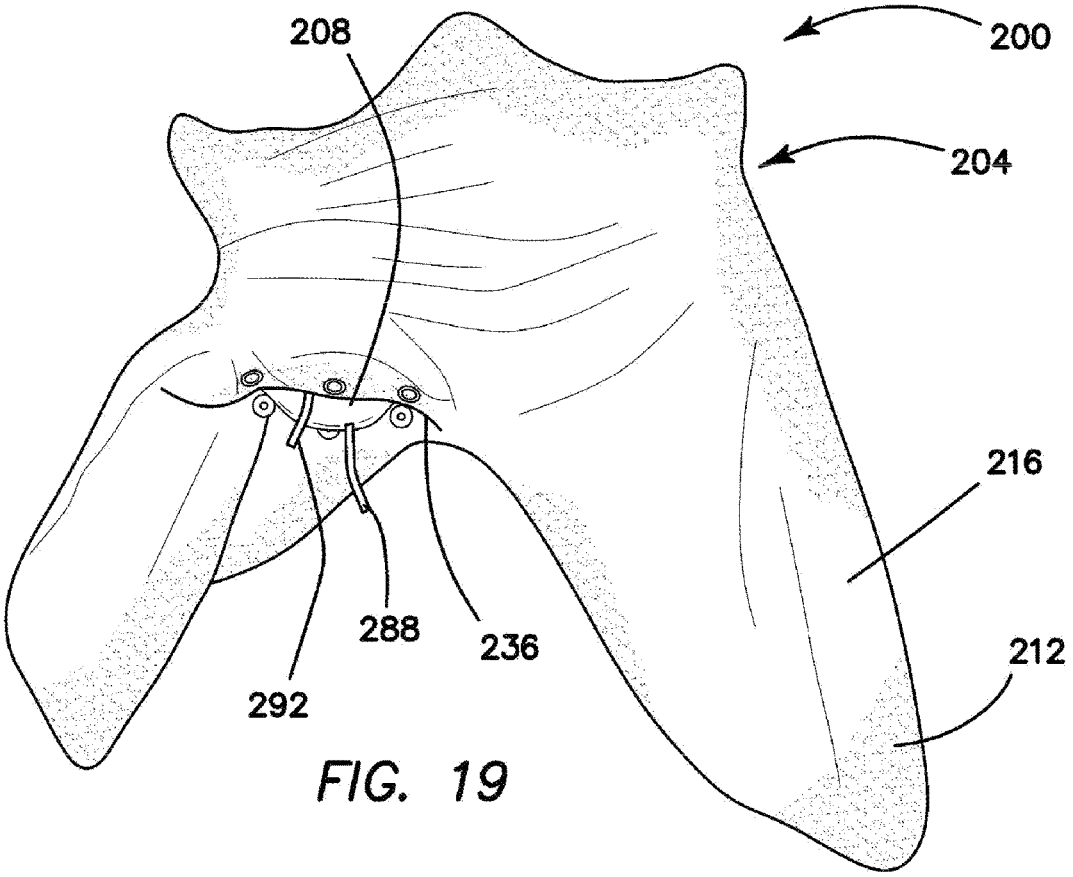
FIG. 19 is a perspective view of the Baby Handling Device illustrating the cover with the pillow inserted and a closable opening for insertion of the pillow.
Figure 20A:
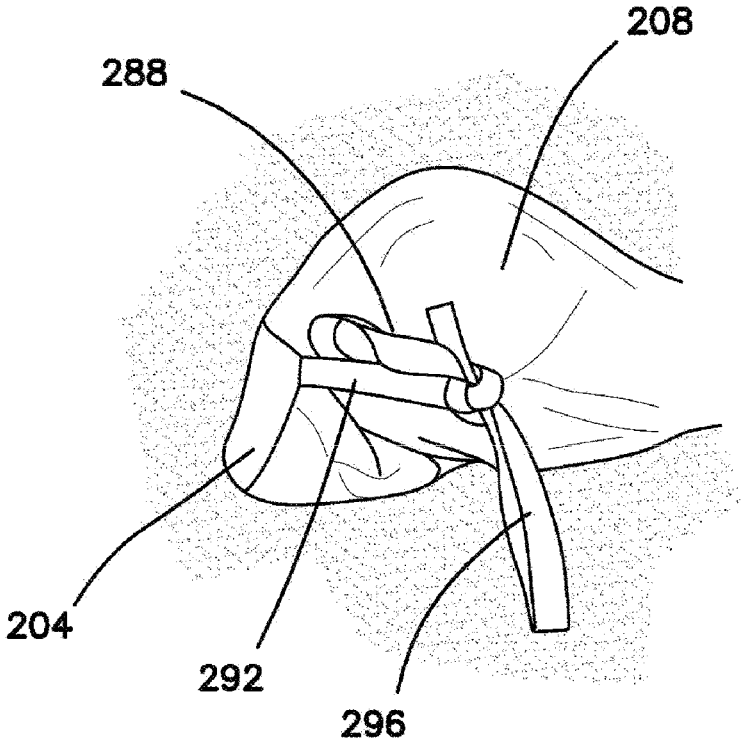
FIG. 20A is a close up view of the closable opening and tie string fastening devices for securing the pillow within the cover.
Figure 20B:
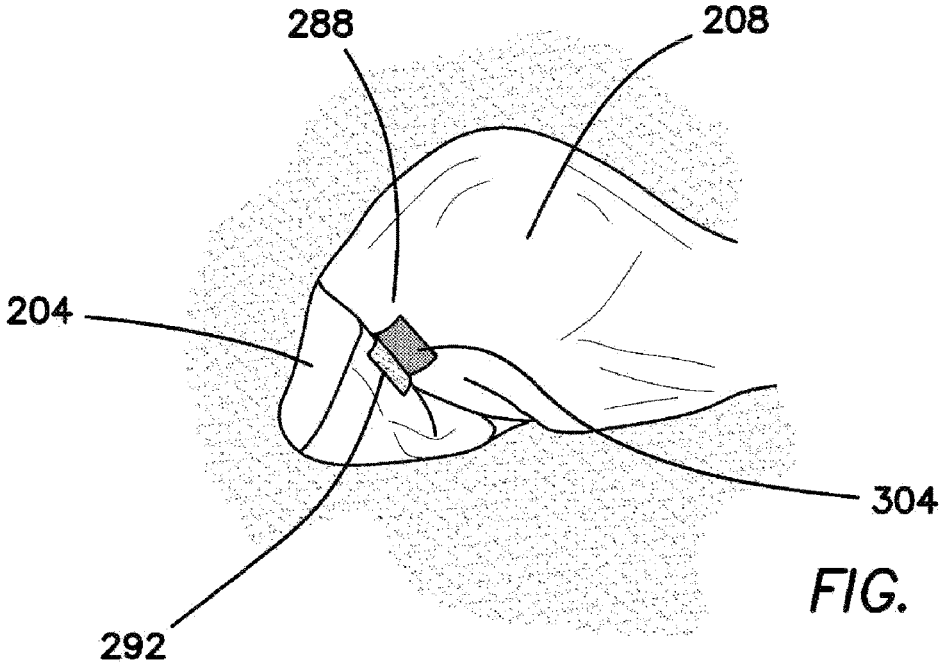
FIG. 20B is a close up view of the closable opening and hooking and looping fastening devices for securing the pillow within the cover.
Figure 21:
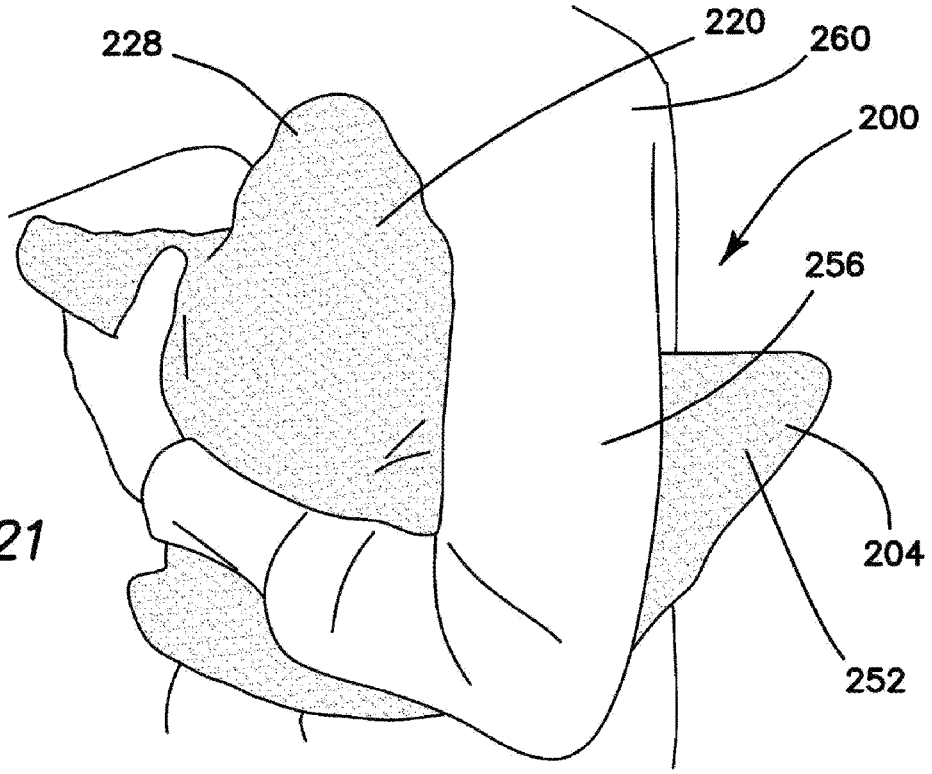
FIG. 21 is a perspective view of the FIG. 19 embodiment secured under a mother's arm.

(11) In yet another variant, as illustrated in FIG. 18, the irregular star-shaped pillow 208 further includes an electrically operated vibrating element 388. The element 388 causes the device 200 to provide a soothing vibration 392 to induce sleep in the baby 220.

(12) In a further variant, the irregular star-shaped pillow 208 further includes at least one loudspeaker 396 and electrically operated sound source 400. The sound source 400 provides music to provide a calming environment for the baby 220.

Figure 27:
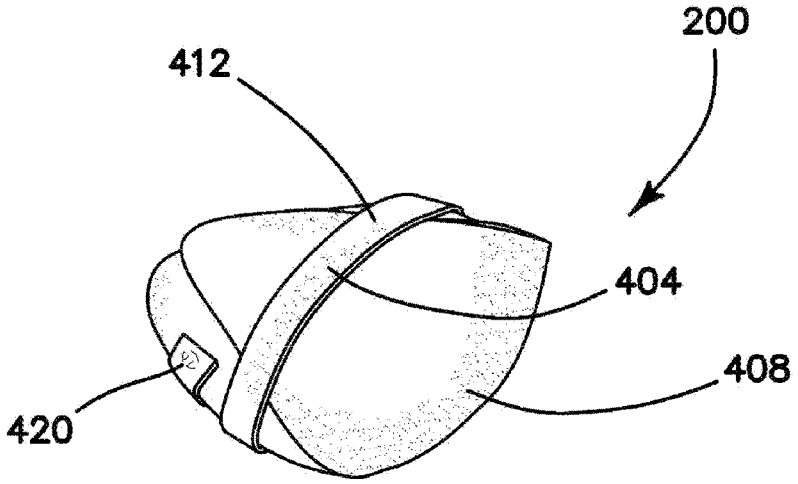
FIG. 27 is a perspective view of the FIG. 19 embodiment secured in a compact bundle with the attachment devices and the combination fastening and carrying strap.

(13) In still a further variant, as illustrated in FIGS. 27 and 28, a combination fastening and carrying strap 404 is provided. The strap 404 serves to hold the device 200 in a compact bundle 408 and to provide a carrying handle 412. The strap 404 is attached to the removable cover 204 with any of stitching (not shown), snaps 420, hook and eye combinations (not shown), buttons (not shown), looping and hooking fasteners (not shown) and zippers (not shown).

(14) In yet a further variant, as illustrated in FIGS. 17A, 17B, 23, 24 and 27, the removable cover 204 includes a plurality of attachment devices 328. The attachment devices 328 secure the elongated star-point shaped extensions 212 about the irregular star-shaped pillow 208 in a compact bundle 408.

(15) In another variant of the invention, as illustrated in FIG. 28, the adjustable combination fastening and carrying strap 404 provides a mounting for baby toys 444 and accessories 448 and is adapted to secure the baby 220 to the irregular star-shaped pillow 208.

Figure 29:
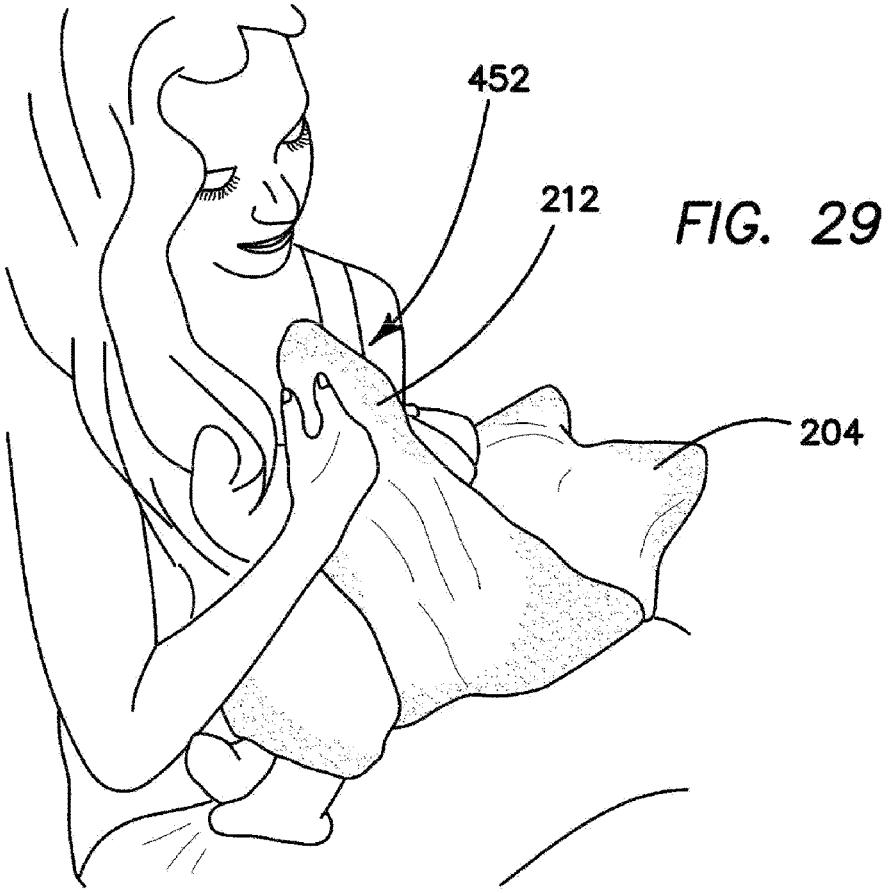
FIG. 29 is a perspective view of a nursing mother using one of the elongated star-point shaped extensions of the FIG. 19 embodiment as a privacy shield.

(16) In still another variant, as illustrated in FIG. 29, the elongated star-point shaped extension 212 of the cover 204 is adapted to provide a privacy shield 452 during nursing.

Figure 30:
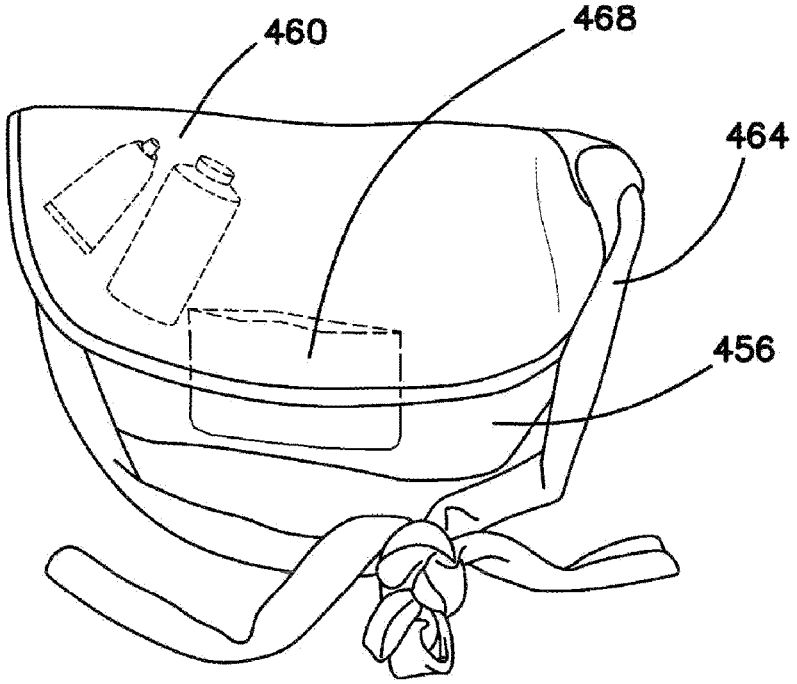
FIG. 30 is a perspective view of a carrying bag for the FIG. 19 embodiment.
Figure 31:
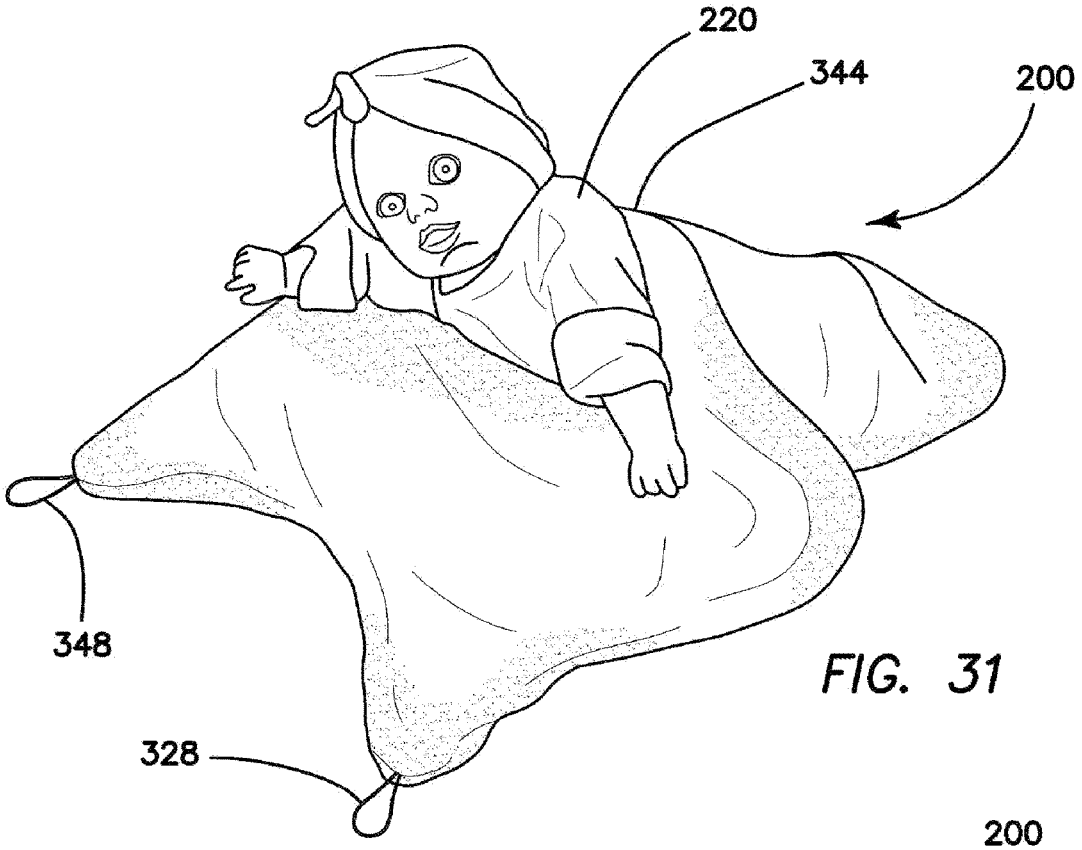
FIG. 31 is a perspective view of the FIG. 19 embodiment securing a baby's legs in a prone position and illustrating tie-string attachment devices.
Figure 32:
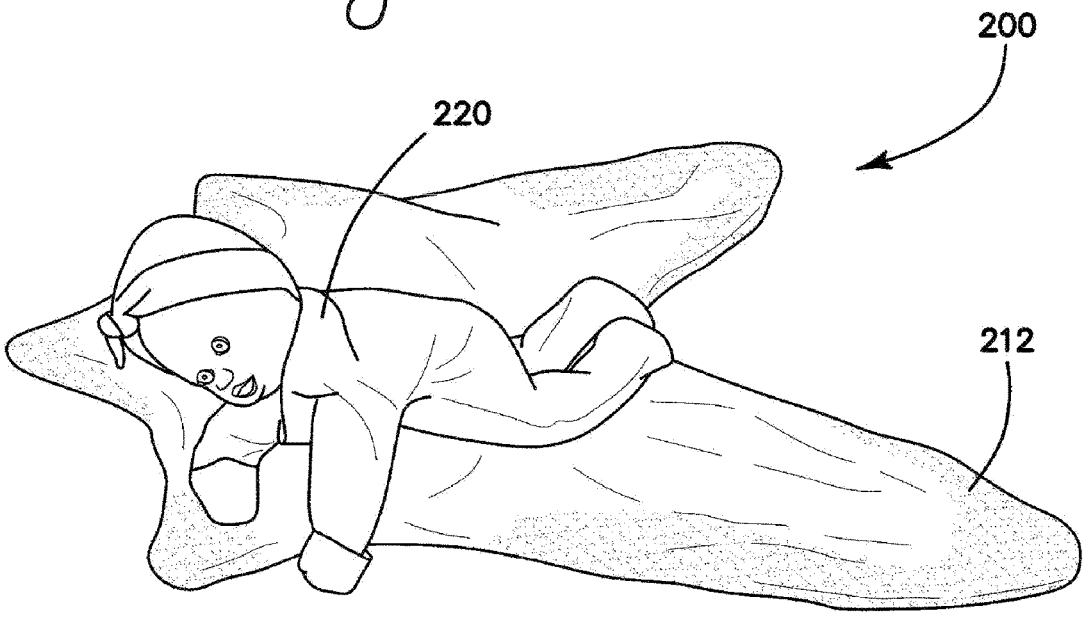
FIG. 32 is a perspective view of the FIG. 19 embodiment supporting a baby in a prone position.
Figure 33:
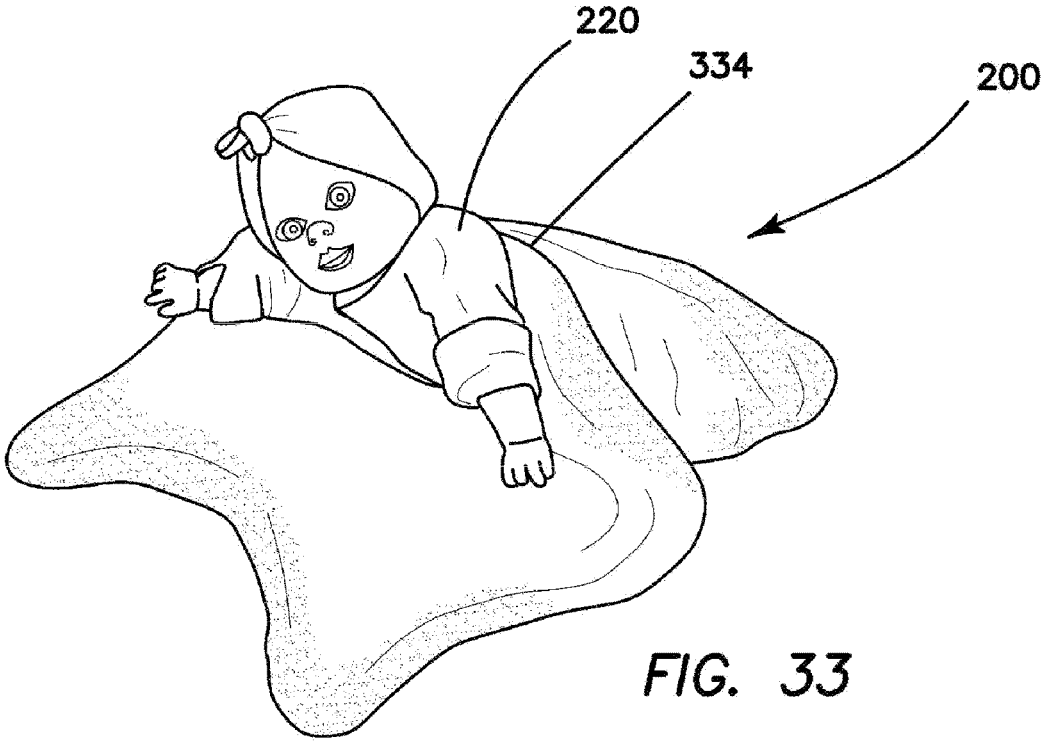
FIG. 33 is a perspective view of the FIG. 19 embodiment securing a baby's legs in a prone position.
Figure 34:
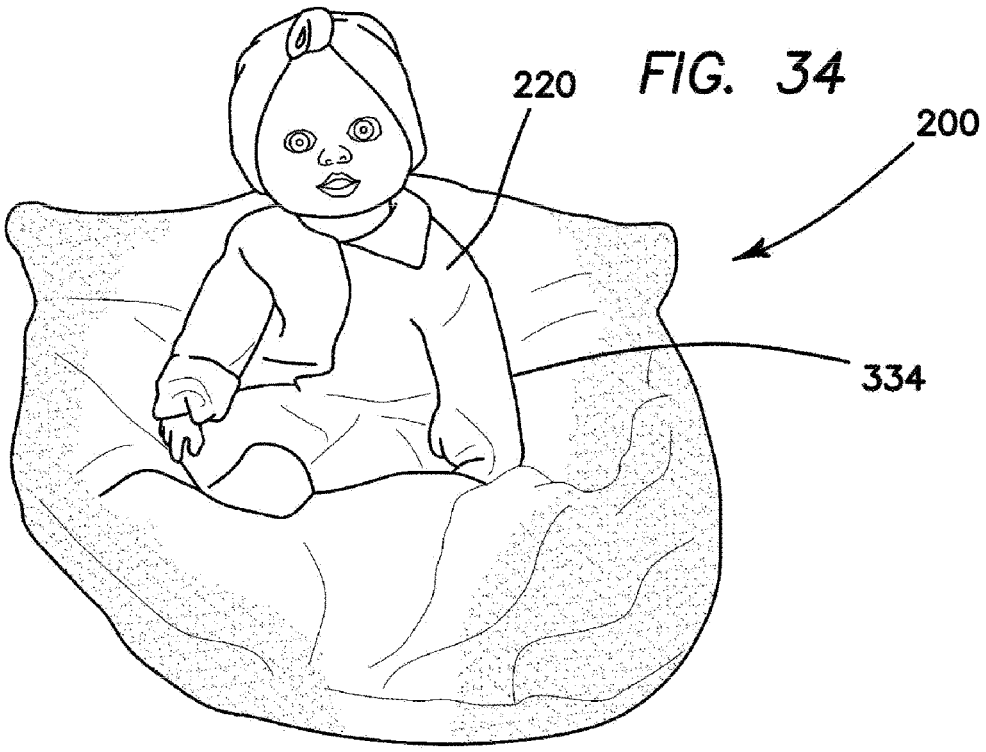
FIG. 34 is a perspective view of the FIG. 19 embodiment supporting a baby in a sitting position.
Figure 35:
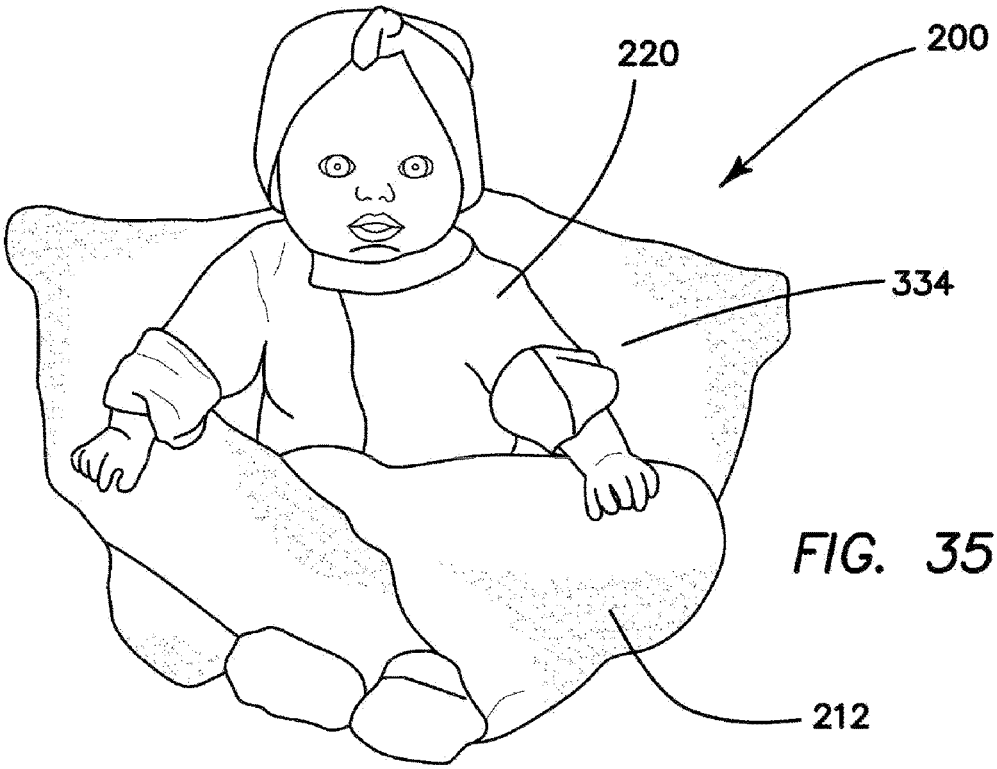
FIG. 35 is a perspective view of the FIG. 19 embodiment supporting a baby in a sitting position with legs secured.
Figure 36:
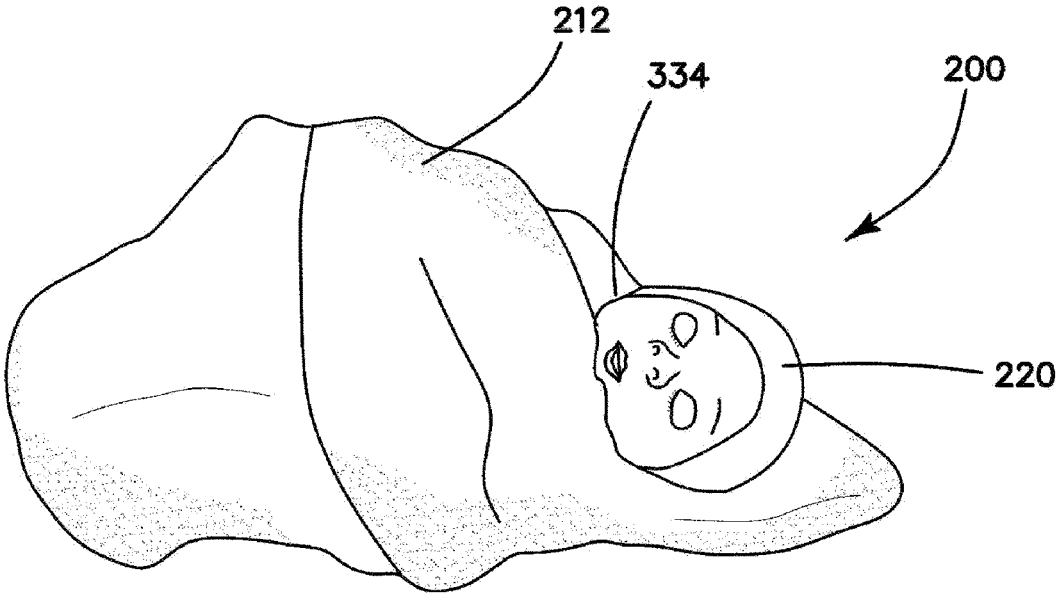
FIG. 36 is a perspective view of the FIG. 19 embodiment supporting a baby in a dorsal position with legs secured.
Figure 37:
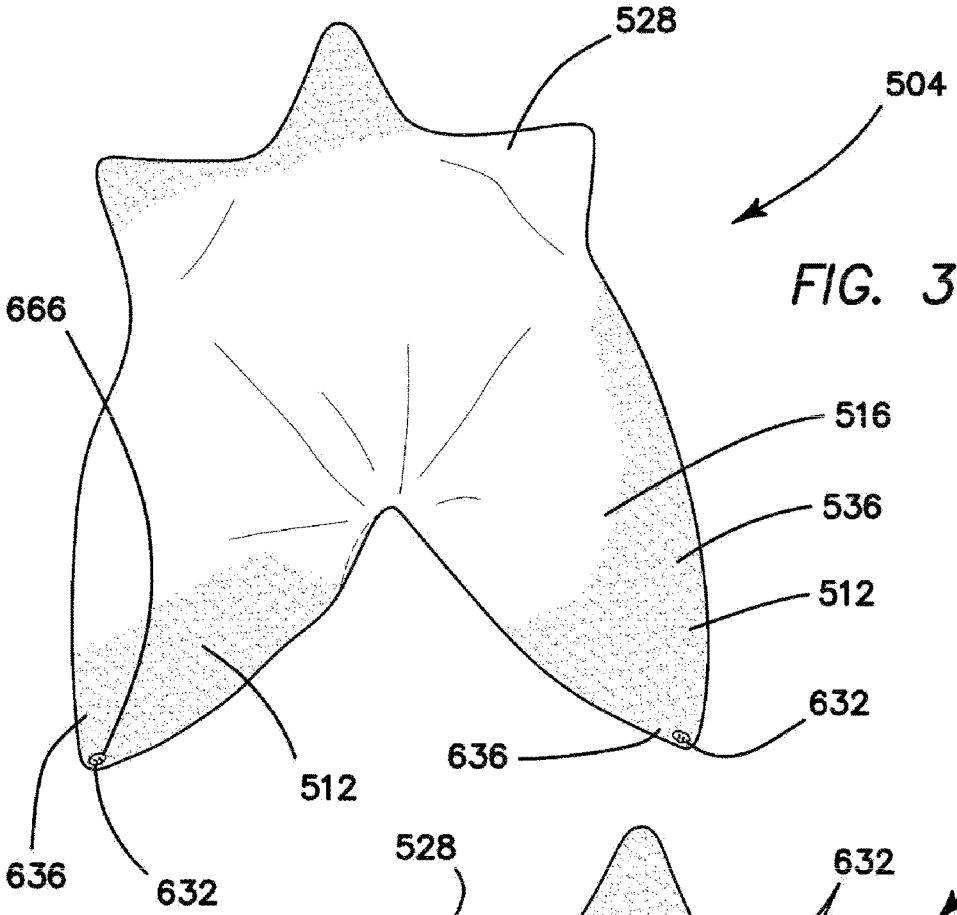
FIG. 37 is a plan view of the front side of a cover of an alternative embodiment of the invention designed for two babies invention illustrating snap attachment devices for securing distal ends of elongated star-shaped portions of the cover.
Figure 38:
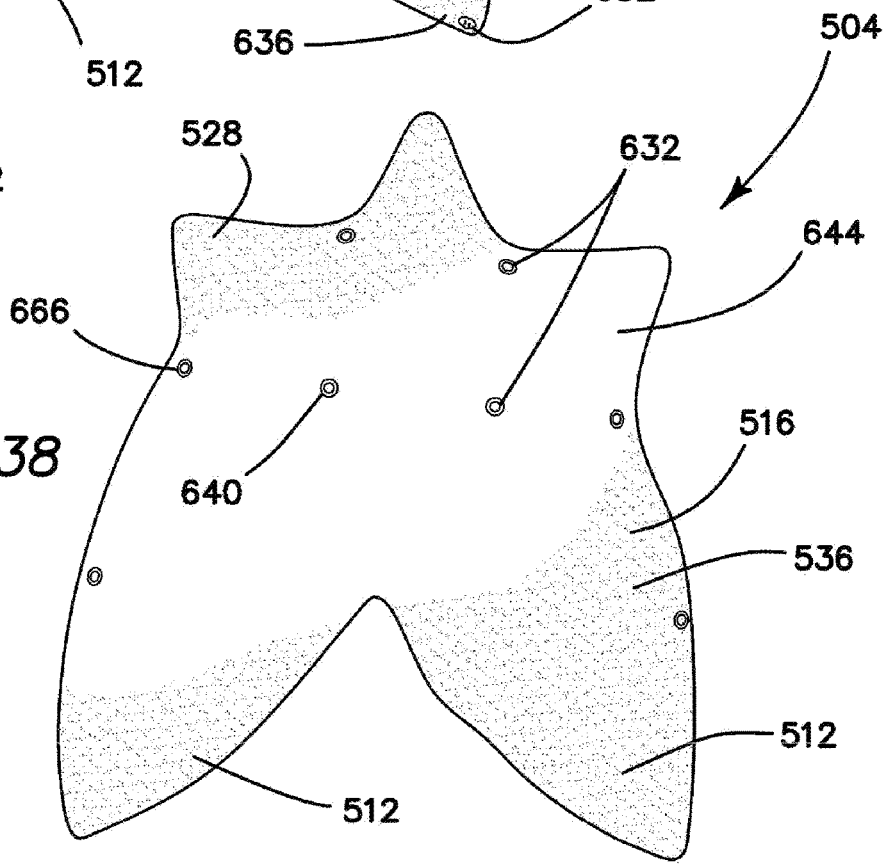
FIG. 38 is a plan view of the back side of a cover of the FIG. 37 embodiment of the invention illustrating snap attachment devices for securing distal ends of elongated star-shaped portions of the cover.
Figure 37A:
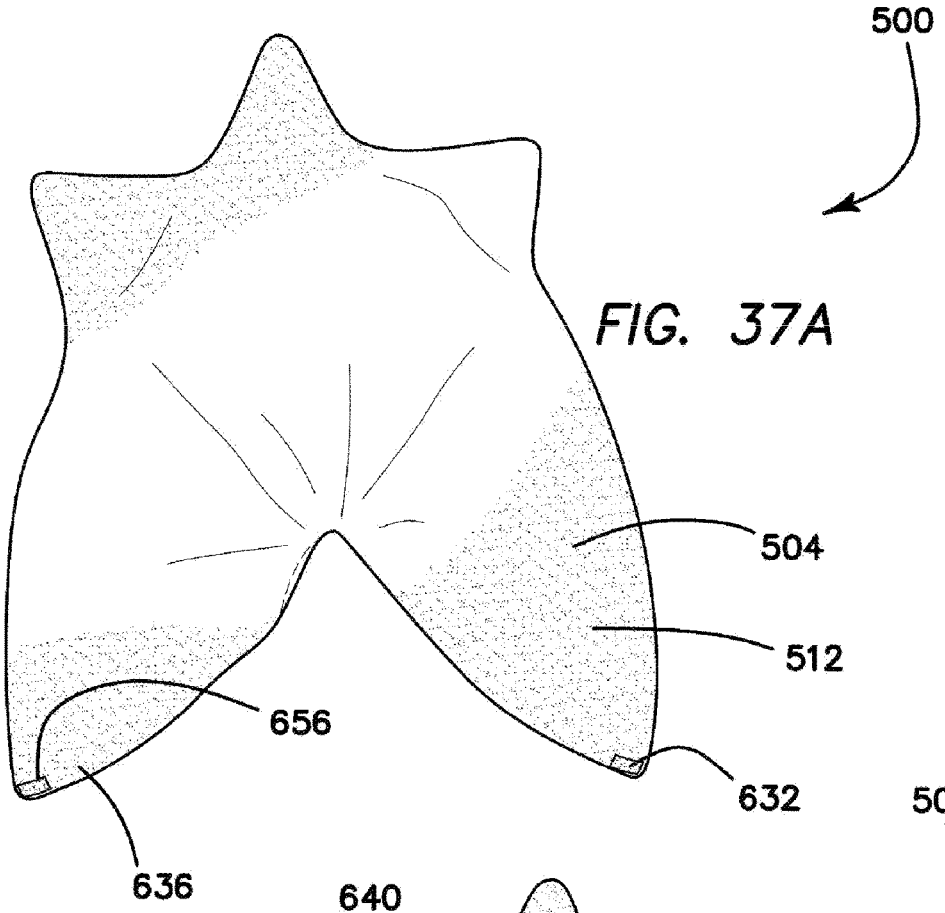
FIG. 37A is a plan view of the front side of a cover of the FIG. 37 embodiment illustrating hooking and looping attachment devices.
Figure 38A:
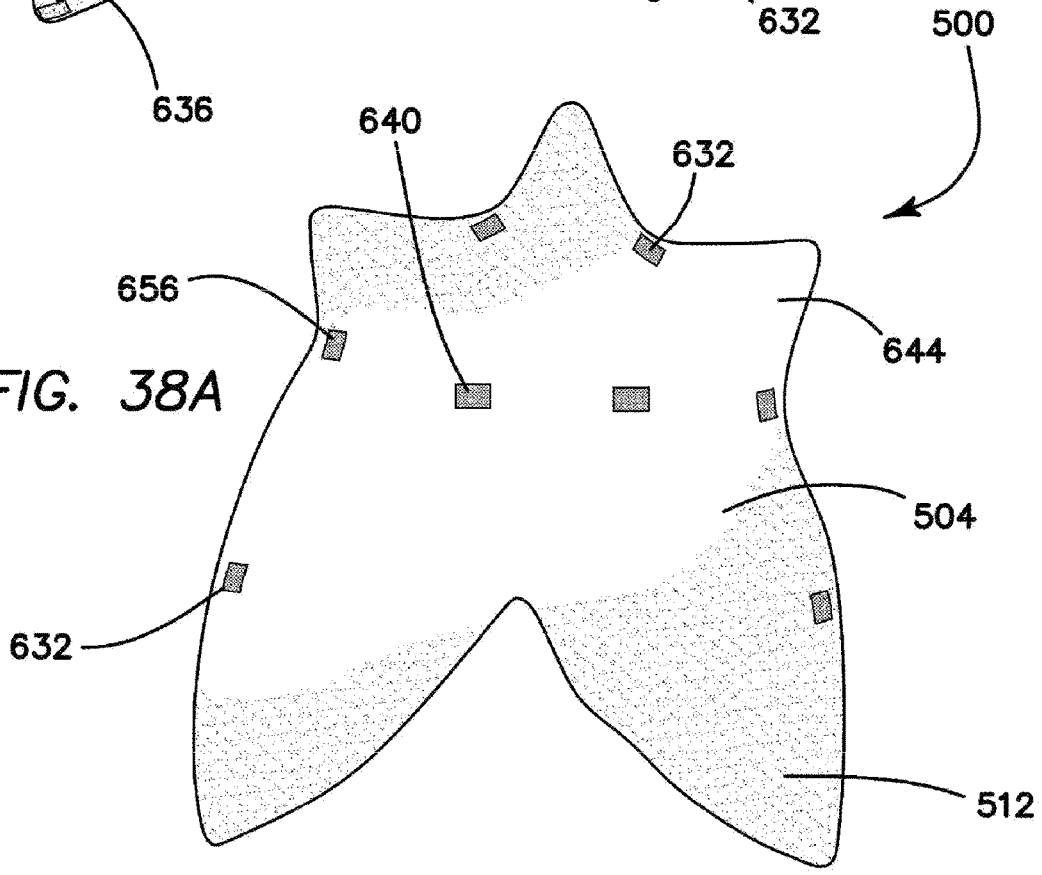
FIG. 38A is a plan view of the back side of a cover of the FIG. 37 embodiment illustrating hooking and looping attachment devices.

(17) In yet another variant, as illustrated in FIG. 30, the baby handling device 200 further includes a carrying bag 456. The bag 456 is sized and shaped to enclose any of the removable, washable pillow cover 204, said irregular star-shaped pillow 208 and baby supplies 460.

(18) In a further variant, a carrying strap 464 is provided.

(19) In still a further variant, the carrying bag 456 further includes at least one pocket 468.

(20) In yet a further variant, as illustrated in FIGS. 37-44 and 49, a baby handling device 500, includes a removable, washable pillow cover 504. The cover 504 is sized and shaped to fit over and extend from an irregular star-shaped pillow 508 and provides at least two elongated star-point shaped extensions 512. The extensions 512 are formed of flexible material 516 and adapted to fold over and enclose at least a portion of two babies 520, 524 positioned on the cover 504. An upper portion 528 of the cover 504 is adapted to support and control movement of heads 228 of two babies 520, 524 when the elongated star-point shaped extensions 512 are wrapped around the babies 520, 524 and fastened to an outer surface 536 of the cover 504. The cover 504 has a closeable opening 540 sized and shaped to permit insertion and removal of the pillow 508.

(21) In another variant of the invention an irregular star-shaped pillow 508 is provided. The pillow 508 is formed of resilient material 544 and includes a broad center section 548 with first 552 and second 556 depressions. The depressions 552, 556 are located on either side of a centerline 560 of the pillow 508. Each depression 552, 556 is sized and shaped to receive a baby's head 228. A central point-shaped portion 564 extends upwardly from the depressions 552, 556. The star-shaped portion 564 is adapted to lodge under an arm 256 of a breast feeding mother 260. First 568 and second 572 side portions of the pillow 508 are provided. The side portions 568, 572 surround a cavity 576. The cavity 576 is sized and shaped to receive the shoulders 276 and torsos 280 of two babies 520, 524. The side portions 568, 572 are sized and shaped to support a baby's arms 284. A central dividing portion 580 extends downwardly from a lower portion 584 of the broad center section 548 and divides the cavity 576 into two spaces 588, 592. The dividing portion 580 is adapted to prevent interference between the two babies 520, 524.

(22) In still another variant, as illustrated in FIGS. 39-42, the irregular star-shaped pillow 508 further includes at least one fastening device 596 and the cover 504 includes at least one mating fastening device 600 for securing the pillow 508 within the cover 504.

(23) In yet another variant, the fastening device 596 is selected from the group includes tie strings 604, hook and eye combinations (not shown), hooking and looping devices 612, buttons (not shown), snaps (not shown) and zippers (not shown).

(24) In a further variant, the irregular star-shaped pillow 508 is formed of impermeable material 320.

Figure 40:
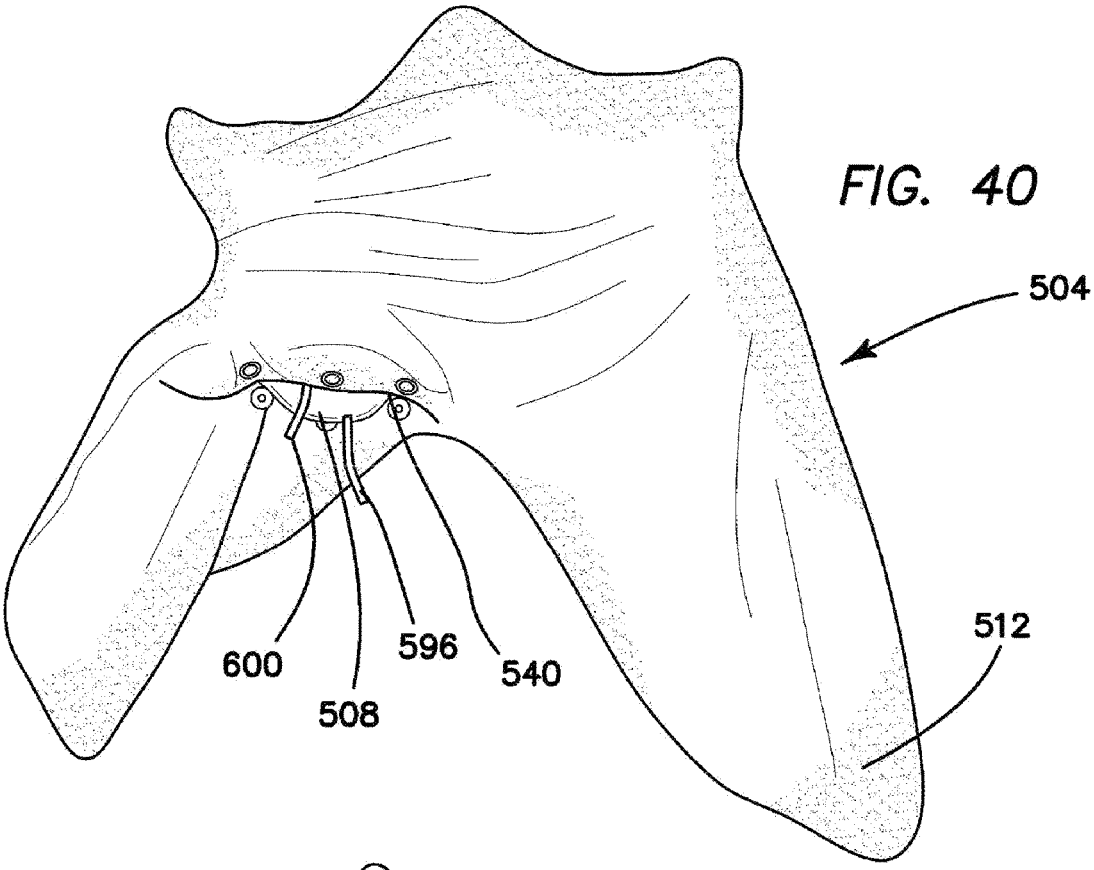
FIG. 40 is a perspective view of the FIG. 37 embodiment illustrating the cover with the pillow inserted and a closable opening for insertion of the pillow.
Figure 40A:
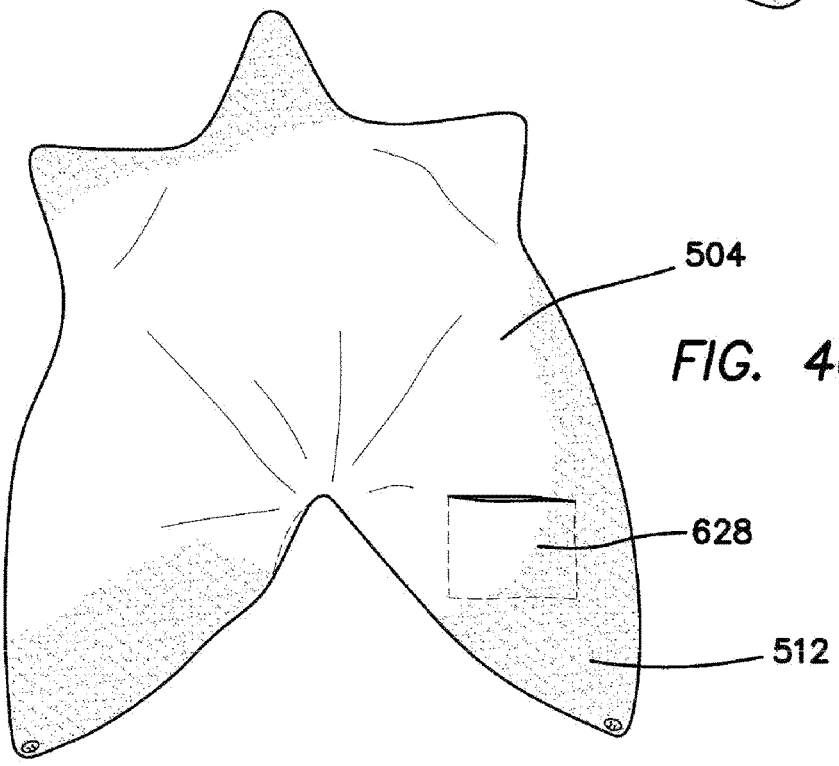
FIG. 40A is a plan view of the FIG. 37 embodiment illustrating an attached pocket.
Figure 41:
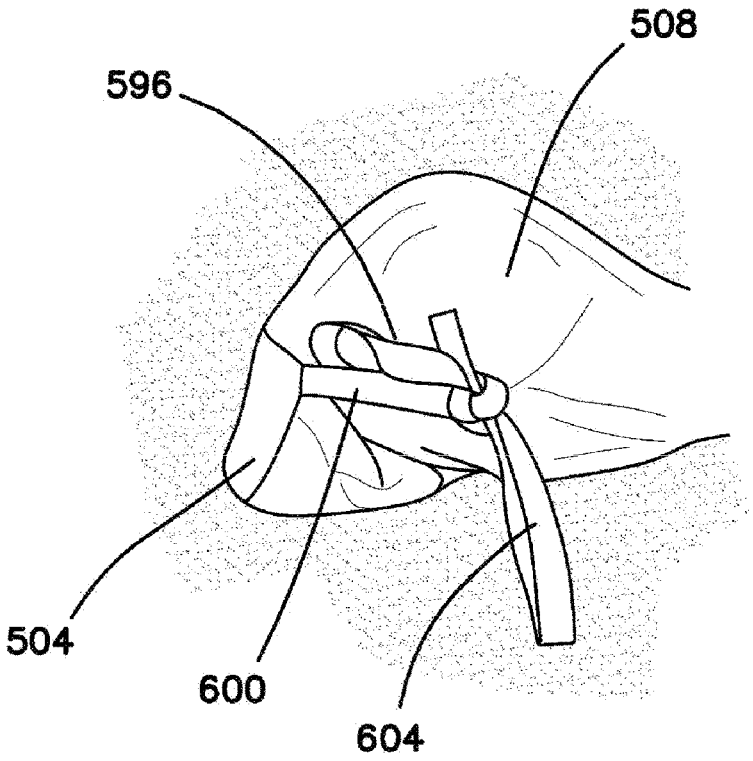
FIG. 41 is a close up view of the closable opening and tie string fastening devices for securing the pillow within the cover.
Figure 42:
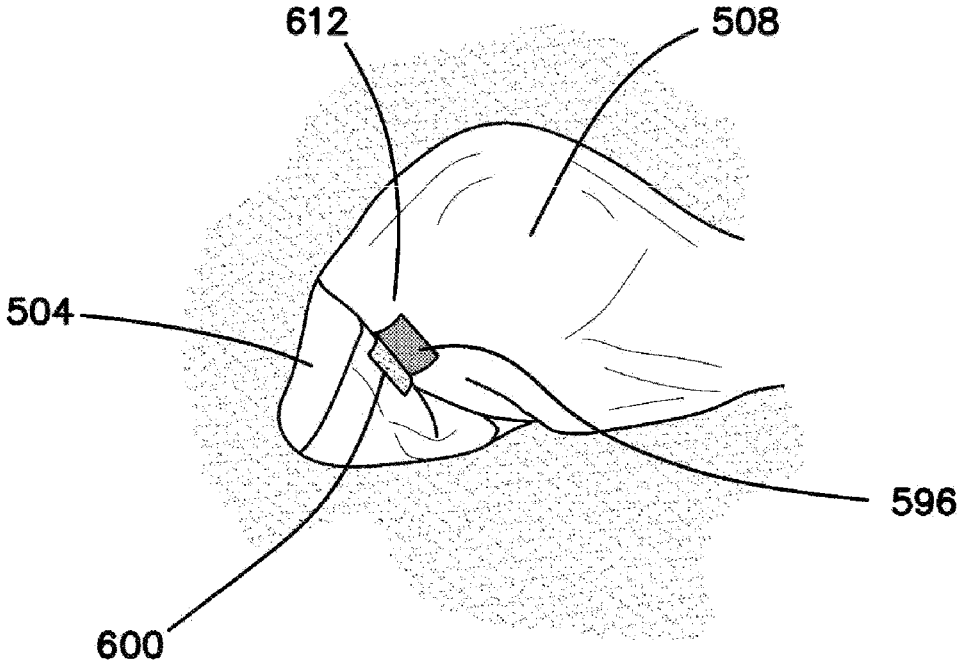
FIG. 42 is a close up view of the closable opening and hooking and looping fastening devices for securing the pillow within the cover.

(25) In still a further variant, as illustrated in FIG. 40A, the removable cover 504 further includes a storage pocket 628.

(26) In yet a further variant, as illustrated in FIGS. 37, 37A, 38, 38A, and 43-48, at least one attachment device 632 is provided. The attachment device 632 provides attachment for a distal end 636 of the elongated star-point shaped extension 512 to at least one location 640 on an exterior surface 644 of the cover 504, thereby adapting the extension 512 to secure the babies 520, 524 in a predetermined position 648.

(27) In another variant of the invention, the attachment device 632 is selected from the group that includes tie strings (not shown), hook and eye combinations (not shown), hooking and looping devices 656, buttons (not shown), snaps 666 and zippers (not shown).

Figure 43:
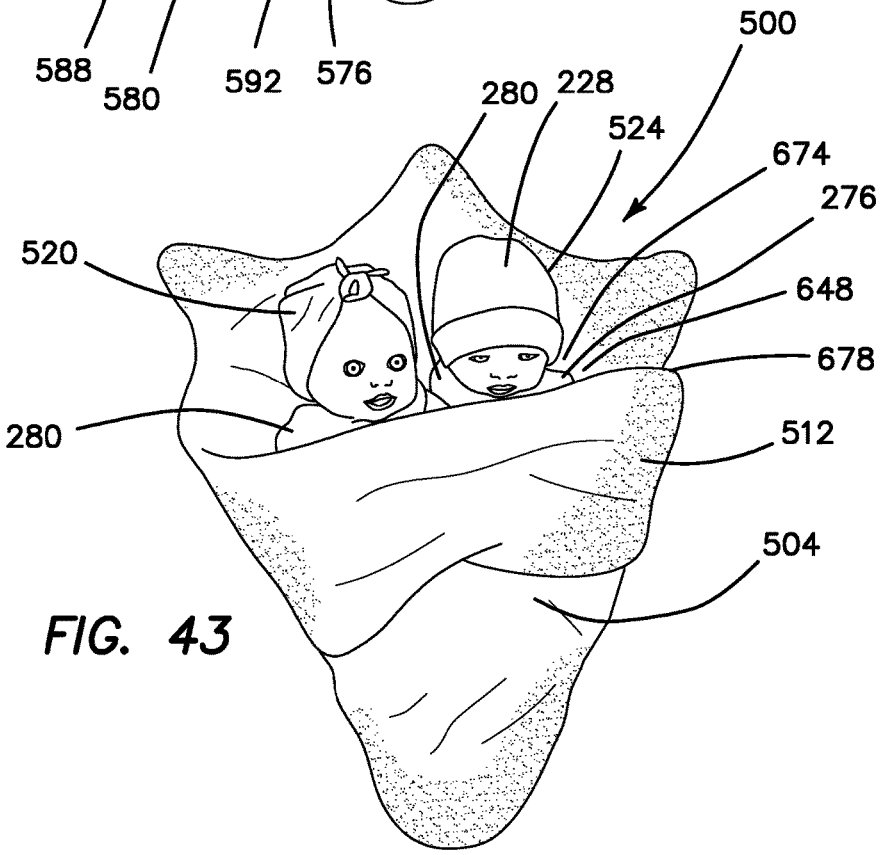
FIG. 43 is a perspective view of the FIG. 37 embodiment illustrating two babies secured in a first position with arms constrained.

(28) In still another variant, as illustrated in FIG. 43, the attachment device 632 is located to secure at least one baby 520, 524 in a first position 674. The first position 674 attaches the extension 512 at shoulder height 678 for the baby 520, 524. The first position 674 constrains the arms 284 of baby 520, 524.

Figure 44:
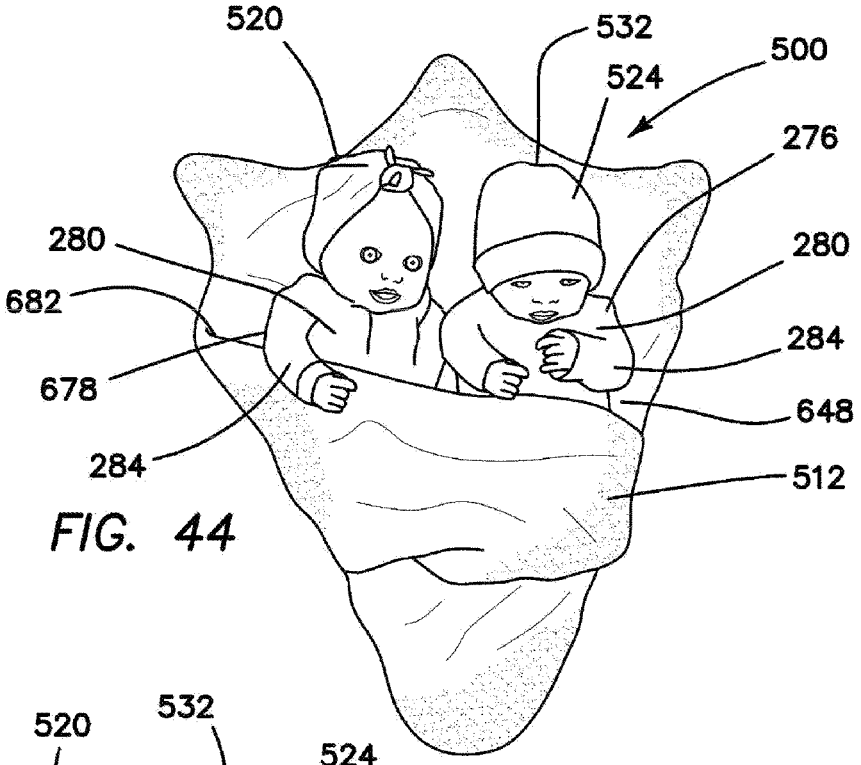
FIG. 44 is a perspective view of the FIG. 37 embodiment illustrating two babies secured in a second position with arms unconstrained.
Figure 45:
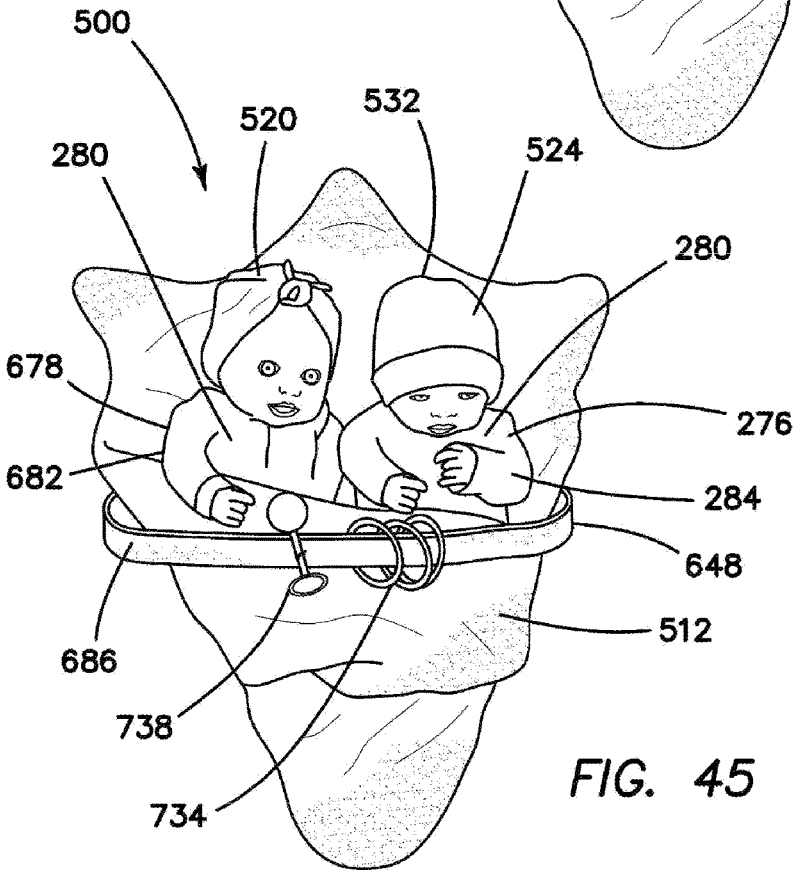
FIG. 45 is a perspective view of the FIG. 37 embodiment illustrating two babies secured in a second position with a combination fastening and carrying strap.
Figure 48:
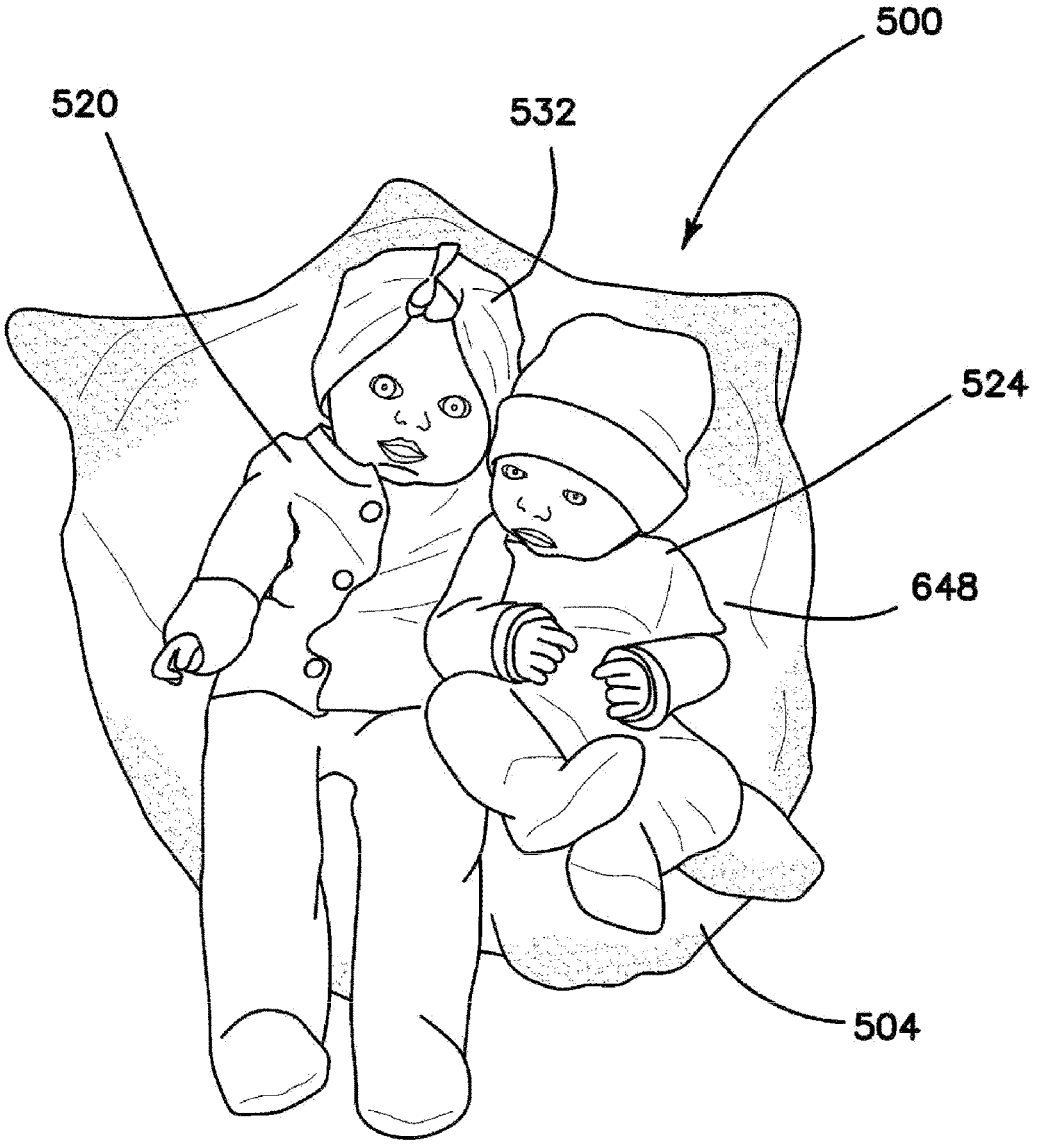
FIG. 48 is a plan view of the FIG. 37 embodiment illustrating two babies in a dorsal position on the invention.

(29) In yet another variant, as illustrated in FIGS. 44 and 45, the attachment device 632 is located to secure at least one baby 520, 524 in a second position 678. The second position 678 attaches the extension 512 at abdomen height 682 for the baby 520, 524. The second position 678 permits movement of arms 284 of the babies 520, 524.

Figure 39:
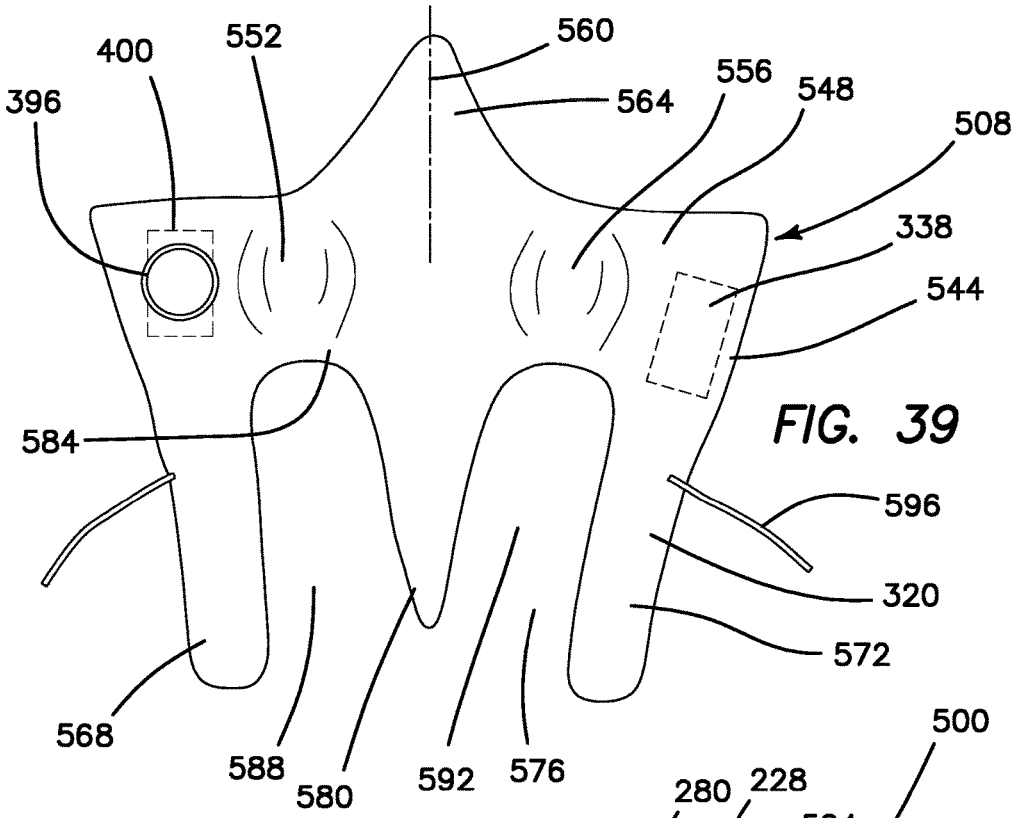
FIG. 39 is a plan view of the star-shaped pillow of the FIG. 37 embodiment illustrating the two cavity spaces for two babies.

(30) In a further variant, as illustrated in FIG. 39, the irregular star-shaped pillow 508 further includes an electrically operated vibrating element 338. The element 338 causes the device 500 to provide a soothing vibration to induce sleep in the babies 520, 524.

(31) In still a further variant, as illustrated in FIG. 39, the irregular star-shaped pillow 508 further includes at least one loudspeaker 396 and electrically operated sound source 400. The sound source 400 provides music to provide a calming environment for the babies 520, 524.

(32) In yet a further variant, as illustrated in FIGS. 45 and 50, a combination fastening and carrying strap 686 is provided. The strap 686 serves to hold the device 500 in a compact bundle 690 and to provide a carrying handle 694. The strap 686 is attached to the removable cover 504 with any of stitching (not shown), snaps 702, hook and eye combinations (not shown), buttons (not shown), looping and hooking fasteners (not shown) and zippers (not shown).

(33) In another variant of the invention, as illustrated in FIGS. 37, 37A, 38, 38A, the removable cover 504 includes a plurality of attachment devices 632. The attachment devices 632 secure the elongated star-point shaped extensions 512 about the irregular star-shaped pillow 508 in a compact bundle 690.

(34) In still another variant, as illustrated in FIG. 45, the adjustable combination fastening and carrying strap 686 provides a mounting for baby toys 734 and accessories 738 and is adapted to secure the babies 520, 524 to the irregular star-shaped pillow 508.

Figure 49:
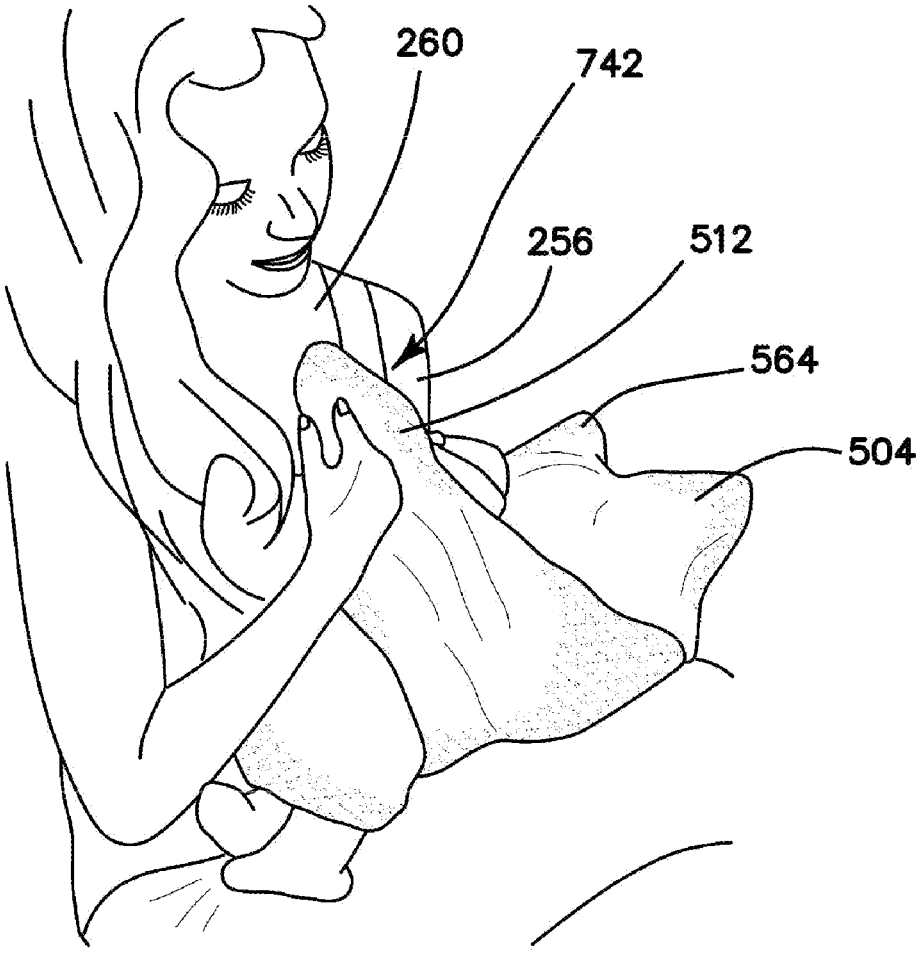
FIG. 49 is a perspective view of the FIG. 37 embodiment illustrating a nursing mother using the cover as a privacy shield.

(35) In yet another variant, as illustrated in FIG. 49, the elongated star-point shaped extension 512 of the cover 504 is adapted to provide a privacy shield 742 during nursing.

(36) In a further variant, as illustrated in FIG. 51, the baby handling device 500 further includes a carrying bag 746. The bag 746 is sized and shaped to enclose any of the removable, washable pillow cover 504, the irregular star-shaped pillow 508 and baby supplies 750.

(37) In still a further variant, a carrying strap 754 is provided.

(38) In, a final variant of the invention, the carrying bag 746 further includes at least one pocket 758.

The baby handling devices 200 and 500 have been described with reference to particular embodiments. Other modifications and enhancements can be made without departing from the spirit and scope of the claims that follow.

The invention claimed is:

1. A baby handling device, comprising:

a removable, washable pillow cover, said cover being sized and shaped to fit over and extend from an irregular star-shaped pillow and providing at least two elongated star-point shaped extensions, said extensions being formed of flexible material and adapted to fold over and enclose at least a portion of a baby positioned on said cover;

an upper portion of said cover adapted to support and control movement of a baby's head when said elongated star-point shaped extensions are wrapped around said baby and fastened to an outer surface of said cover; and said cover having a closeable opening sized and shaped to permit insertion and removal of said pillow.

2. The baby handling device, as described in claim 1, further comprising an irregular star-shaped pillow, said pillow being formed of resilient material and comprising:

a broad center section with a central depression sized and shaped to receive a baby's head;

a central point-shaped portion extending upwardly from said depression, said central point-shaped portion adapted to lodge under an arm of a breast feeding mother; and first and second side portions, said side portions surrounding a cavity, said cavity being sized and shaped to receive the shoulders and torso of said baby, said side portions being sized and shaped to support a baby's arms.

3. The baby handling device, as described in claim 2, wherein said irregular star-shaped pillow further comprises at least one fastening device and said cover comprises at least one mating fastening device for securing said pillow within said cover.

4. The baby handling device, as described in claim 3, wherein said at least one fastening device is selected from the group comprising:

tie strings, hook and eye combinations, hooking and looping devices, buttons, snaps and zippers.

5. The baby handling device, as described in claim 2, wherein said irregular star-shaped pillow is formed of impermeable material.

6. The baby handling device, as described in claim 1, wherein said removable cover further includes a storage pocket.

7. The baby handling device, as described in claim 1, further comprising at least one attachment device, said at least one attachment device providing attachment for a distal end of said elongated star-point shaped extensions to at least one location on an exterior surface of said cover, thereby adapting said extensions to secure said baby in a predetermined position.

8. The baby handling device, as described in claim 7, wherein said at least one attachment device in selected from the group comprising:

tie strings, hook and eye combinations, hooking and looping devices, buttons, snaps and zippers.

9. The baby handling device, as described in claim 7, wherein said at least one attachment device is disposed to secure said baby in a first position, said first position attaching said extension at shoulder height for said baby, said first position constraining arms of said baby.

10. The baby handling device, as described in claim 7, wherein said at least one attachment device is disposed to secure said baby in a second position, said second position attaching said extension at abdomen height for said baby, said second position permitting movement of arms of said baby.

11. The baby handling device, as described in claim 2, wherein said irregular star-shaped pillow further comprises an electrically operated vibrating element, said element causing said device to provide a soothing vibration to induce sleep in said baby.

12. The baby handling device, as described in claim 2, wherein said irregular star-shaped pillow further comprises at least one loudspeaker and electrically operated sound source, said sound source providing music to provide a calming environment for said baby.

13. The baby handling device, as described in claim 1, further comprising a combination fastening and carrying strap, said strap serving to hold the device in a compact bundle and to provide a carrying handle, said strap being attached to said removable cover with any of stitching, snaps, hook and eye combinations, buttons, snaps, looping and hooking fasteners and zippers.

14. The baby handling device, as described in claim 1, wherein said removable cover comprises a plurality of attachment devices, said attachment devices securing said elongated star-point shaped extensions about said irregular star-shaped pillow in a compact bundle.

15. The baby handling device, as described in claim 13, wherein said adjustable combination fastening and carrying strap provides a mounting for baby toys and accessories and is adapted to secure said baby to the irregular star-shaped pillow.

16. The baby handling device, as described in claim 1, wherein each of said elongated star-point shaped extensions of said cover is adapted to provide a privacy shield during nursing.

17. The baby handling device, as described in claim 2, further comprising a carrying bag, said bag being sized and shaped to enclose any of said removable, washable pillow cover, said irregular star-shaped pillow and baby supplies.

18. The baby handling device, as described in claim 17, further comprising attachments for a carrying strap.

19. The baby handling device, as described in claim 17, wherein said carrying bag further comprises at least one pocket.

20. A baby handling device, comprising:

a removable, washable pillow cover, said cover being sized and shaped to fit over and extend from an irregular star-shaped pillow and providing at least two elongated star-point shaped extensions, said extensions being formed of flexible material and adapted to fold over and enclose at least a portion of two babies positioned on said cover;

an upper portion of said cover adapted to support and control movement of the heads of said two babies when said elongated star-point shaped extensions are wrapped around said babies and fastened to an outer surface of said cover; and said cover having a closeable opening sized and shaped to permit insertion and removal of said pillow.

21. The baby handling device, as described in claim 20, further comprising an irregular star-shaped pillow, said pillow being formed of resilient material and comprising:

a broad center section with first and second depressions, said depressions being disposed on either side of a centerline of said pillow and each being sized and shaped to receive a baby's head;

a central point-shaped portion extending upwardly from said depressions, said central point-shaped portion adapted to lodge under an arm of a breast feeding mother;

first and second side portions, said side portions surrounding a cavity, said cavity being sized and shaped to receive the shoulders and torsos of two babies, said side portions being sized and shaped to support a baby's arms;

a central dividing portion, said central dividing portion extending downwardly from a lower portion of said broad center section and dividing said cavity into two spaces;

said central dividing portion adapted to prevent interference between said two babies.

22. The baby handling device, as described in claim 21, wherein said irregular star-shaped pillow further comprises at least one fastening device and said cover comprises at least one mating fastening device for securing said pillow within said cover.

23. The baby handling device, as described in claim 22, wherein said at least one fastening device is selected from the group comprising:

tie strings, hook and eye combinations, hooking and looping devices, buttons, snaps and zippers.

24. The baby handling device, as described in claim 21, wherein said irregular star-shaped pillow is formed of impermeable material.

25. The baby handling device, as described in claim 20, wherein said removable cover further includes a storage pocket.

26. The baby handling device, as described in claim 20, further comprising at least one attachment device, said at least one attachment device providing attachment for a distal end of said elongated star-point shaped extensions to at least one location on an exterior surface of said cover, thereby adapting said extensions to secure said babies in a predetermined position.

27. The baby handling device, as described in claim 26, wherein said at least one attachment device is selected from the group comprising:

tie strings, hook and eye combinations, hooking and looping devices, buttons, snaps and zippers.

28. The baby handling device, as described in claim 26, wherein said at least one attachment device is disposed to secure at least one baby in a first position, said first position attaching said extensions at shoulder height for said at least one baby, said first position constraining arms of said at least one baby.

29. The baby handling device, as described in claim 26, wherein said at least one attachment device is disposed to secure at least one baby in a second position, said second position attaching said extensions at abdomen height for said at least one baby, said second position permitting movement of arms of said at least one baby.

30. The baby handling device, as described in claim 21, wherein said irregular star-shaped pillow further comprises an electrically operated vibrating element, said element causing said device to provide a soothing vibration to induce sleep in said babies.

31. The baby handling device, as described in claim 21, wherein said irregular star-shaped pillow further comprises at least one loudspeaker and electrically operated sound source, said sound source providing music to provide a calming environment for said babies.

32. The baby handling device, as described in claim 20, further comprising a combination fastening and carrying strap, said strap serving to hold the device in a compact bundle and to provide a carrying handle, said strap being attached to said removable cover with any of stitching, snaps, hook and eye combinations, buttons, looping and hooking fasteners and zippers.

33. The baby handling device, as described in claim 20, wherein said removable cover comprises a plurality of attachment devices, said attachment devices securing said elongated star-point shaped extensions about said irregular star-shaped pillow in a compact bundle.

34. The baby handling device, as described in claim 32, wherein said adjustable combination fastening and carrying strap provides a mounting for baby toys and accessories and is adapted to secure said babies to the irregular star-shaped pillow.

35. The baby handling device, as described in claim 20, wherein each of said elongated star-point shaped extensions of said cover is adapted to provide a privacy shield during nursing.

36. The baby handling device, as described in claim 21, further comprising a carrying bag, said bag being sized and shaped to enclose any of said removable, washable pillow cover, said the irregular star-shaped pillow and baby supplies.

37. The baby handling device, as described in claim 36, further comprising attachments for a carrying strap.

38. The baby handling device, as described in claim 36, further comprising at least one pocket.

* * * * *